US011238841B2

(12) United States Patent
Wang et al.

(10) Patent No.: US 11,238,841 B2
(45) Date of Patent: Feb. 1, 2022

(54) ACTIVE NOISE CONTROL DEVICE

(71) Applicant: HONDA MOTOR CO., LTD., Tokyo (JP)

(72) Inventors: Xun Wang, Wako (JP); Toshio Inoue, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/215,471

(22) Filed: Mar. 29, 2021

(65) Prior Publication Data

US 2021/0304728 A1 Sep. 30, 2021

(30) Foreign Application Priority Data

Mar. 31, 2020 (JP) ..... JP2020-062570
Feb. 8, 2021 (JP) ..... JP2021-018455

(51) Int. Cl.
*G10K 11/178* (2006.01)

(52) U.S. Cl.
CPC ..... *G10K 11/17883* (2018.01); *G10K 11/17823* (2018.01); *G10K 11/17835* (2018.01); *G10K 11/17854* (2018.01); *G10K 2210/1282* (2013.01)

(58) Field of Classification Search
CPC ..... G10K 11/17813; G10K 11/17815; G10K 11/17817; G10K 11/17854; G10K 2210/3025; G10K 2210/3033
See application file for complete search history.

(56) References Cited

U.S. PATENT DOCUMENTS

2005/0207585 A1* 9/2005 Christoph ..... G10K 11/17883 381/71.11
2008/0292110 A1 11/2008 Kobayashi et al.

FOREIGN PATENT DOCUMENTS

JP 2008-239098 A 10/2008

* cited by examiner

*Primary Examiner* — Kile O Blair
(74) *Attorney, Agent, or Firm* — Carrier Blackman & Associates, P.C.; Joseph P. Carrier; William D. Blackman

(57) ABSTRACT

An active noise control device includes an updated value table operating unit that writes initial values of an initial value table into an updated value table as updated values and writes updated coefficients of a secondary path filter Cˆ updated in a secondary path filter coefficient updating unit during active noise control, into the updated value table as updated values. The secondary path filter coefficient updating unit reads the updated value corresponding to a frequency from the updated value table before updating the coefficients of the secondary path filter Cˆ, and updates the coefficients of the secondary path filter Cˆ, using the read updated values as the pervious values.

8 Claims, 22 Drawing Sheets

ENGINE
18
PRIMARY PATH
H
d
22
e
44
e1
46
-1
48
50
y
SECONDARY PATH
C
16
17
D/A
54
y1^
30
30a
30b
30c
C0^
C1^
LMS
40a
40b
40
d^
32
32a
32b
32c
H0^
-H1^
38a
38b
38
u0
u1
28
28a
28b
28c
28d
28e
28f
W0
W1
-W0
26b
COSINE SIGNAL GENERATOR
SINE SIGNAL GENERATOR
26c
xc
xs
f
FREQUENCY DETECTION CIRCUIT
26a
26
Ne e2
52
78
α
80
y2^
36
36a
36b
36c
42a
42b
42
34
34a
34b
34c
34d
34e
34f
r0
r1
-C1^

ACTIVE NOISE CONTROL DEVICE

CROSS-REFERENCE TO RELATED APPLICATIONS

This application is based upon and claims the benefit of priority from Japanese Patent Applications No. 2020-062570 filed on Mar. 31, 2020 and No. 2021-018455 filed on Feb. 8, 2021, the contents all of which are incorporated herein by reference.

BACKGROUND OF THE INVENTION

Field of the Invention

The present invention relates to an active noise control device that performs active noise control by controlling a speaker based on an error signal that changes in accordance with a combined sound of a noise transmitted from a vibration source and an anti-noise sound output from the speaker in order to cancel the noise.

Description of the Related Art

Japanese Laid-Open Patent Publication No. 2008-239098 discloses a system in which a standard signal is generated based on the rotation frequency of the propeller shaft, and the generated standard signal is then signal-processed through an adaptive filter to generate a control signal for outputting an anti-noise sound from a speaker so as to cancel out noise transmitted from the propeller shaft into the vehicle. In this system, the adaptive filter is updated based on an error signal output by a microphone installed in the vehicle and a reference signal generated by correcting the standard signal with a correction value.

SUMMARY OF THE INVENTION

In Japanese Laid-Open Patent Publication No. 2008-239098, since the transfer characteristic of the anti-noise sound between the speaker and the microphone is measured in advance and the measured characteristic is used as correction values, there is a concern that the noise cannot be reduced if the transfer characteristic changes.

The present invention has been devised to solve the above problem, it is therefore an object of the present invention to provide an active noise control device capable of reducing noise even if the transfer characteristic changes.

An aspect of the present invention resides in an active noise control device that performs active noise control for controlling a speaker based on an error signal that changes in accordance with the combined sound of a noise transmitted from a vibration source and an anti-noise sound for cancelling the noise, output from the speaker, the active noise control device including: a standard signal generation unit configured to generate a standard signal in accordance with a control target frequency; a control signal generation unit configured to generate a control signal for controlling the speaker by signal-processing the standard signal through a control filter that is an adaptive notch filter; an estimated noise signal generation unit configured to generate an estimated noise signal by signal-processing the standard signal through a primary path filter that is an adaptive notch filter; a first estimated anti-noise signal generation unit configured to generate a first estimated anti-noise signal by signal-processing the control signal through a secondary path filter that is an adaptive notch filter; a reference signal generation unit configured to generate a reference signal by signal processing the standard signal through the secondary path filter; a second estimated anti-noise signal generation unit configured to generate a second estimated anti-noise signal by signal-processing the reference signal through the control filter; a first virtual error signal generation unit configured to generate a first virtual error signal from the error signal, the first estimated anti-noise signal and the estimated noise signal; a second virtual error signal generation unit configured to generate a second virtual error signal from the second estimated anti-noise signal and the estimated noise signal; a secondary path filter coefficient updating unit configured to successively and adaptively update the coefficients of the secondary path filter so as to minimize the magnitude of the first virtual error signal, based on the control signal and the first virtual error signal; a control filter coefficient updating unit configured to successively and adaptively update the coefficients of the control filter so as to minimize the magnitude of the second virtual error signal, based on the reference signal and the second virtual error signal; an initial value table configured to store initial values of the coefficients of the secondary path filter in association with a frequency, in a table format; an updated value table configured to store updated values of the coefficients of the secondary path filter in association with the frequency, in a table format; an updated value table operating unit configured to write the initial values of the initial value table into the updated value table as the updated values at the start of the active noise control and write the coefficients of the secondary path filter updated by the secondary path filter coefficient updating unit during the active noise control, into the updated value table as the updated values, wherein the secondary path filter coefficient updating unit is configured to read the updated values corresponding to the frequency from the updated value table before updating the coefficients of the secondary path filter, and update the coefficients of the secondary path filter, using the read updated values as the previous values.

The active noise control device of the present invention can reduce noise even if the transfer characteristic changes.

The above and other objects, features, and advantages of the present invention will become more apparent from the following description when taken in conjunction with the accompanying drawings, in which preferred embodiments of the present invention are shown by way of illustrative example.

DESCRIPTION OF THE PREFERRED EMBODIMENTS

First Embodiment

Figure 1:
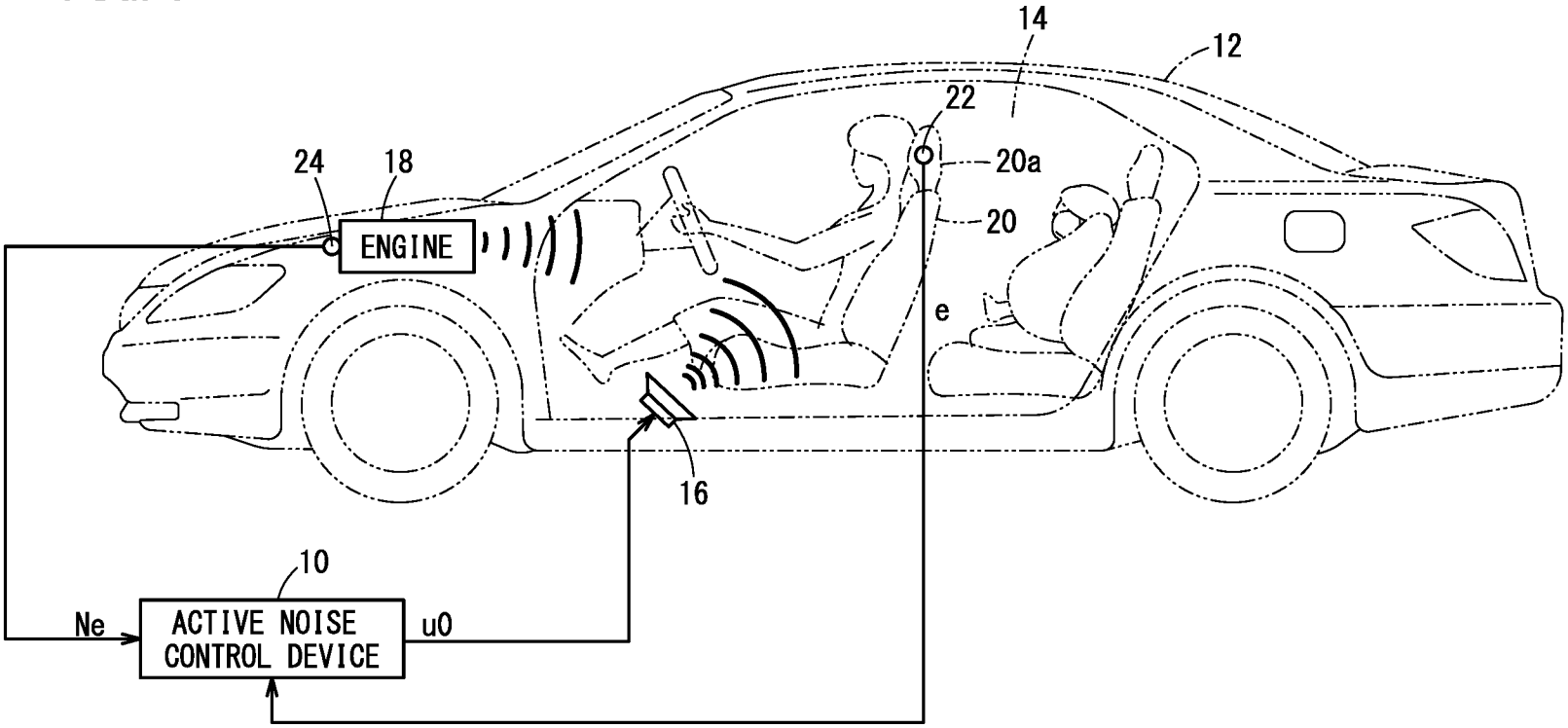
FIG. 1 is a diagram illustrating an outline of active noise control.

FIG. 1 is a diagram illustrating an outline of active noise control achieved by an active noise control device 10.

The active noise control device 10 outputs an anti-noise sound from a speaker 16 installed in a vehicle passenger compartment 14 of a vehicle 12, so as to reduce the engine's booming noise (hereinafter referred to as noise) transmitted to the occupant in the vehicle passenger compartment 14 resulting from the vibration of an engine 18. The active noise control device 10 generates a control signal u0 for causing the speaker 16 to output an anti-noise sound based on an error signal e output from a microphone 22 arranged on a headrest 20*a* of a seat 20 in the vehicle passenger compartment 14 and the engine speed Ne detected by an engine speed sensor 24. The error signal e is a signal that is output according to a canceling error noise from the microphone 22 detecting the canceling error noise which is a combination of the anti-noise sound and the noise.

Conventional Active Noise Control Device

Conventionally, there has been proposed an active noise control device which uses adaptive notch filters (for example, SAN (Single-frequency Adaptive Notch) filters) that need a limited amount of arithmetic processing.

In the conventional active noise control device, first, a standard signal x having a frequency (control target frequency) of noise to be canceled is generated. The generated standard signal x is signal-processed through a control filter W as an adaptive notch filter to produce a control signal u0. This control signal u0 is used to control the speaker 16 and cause the speaker 16 to output an anti-noise sound for canceling out the noise.

The control filter W is updated by an adaptive algorithm (for example, LMS (Least Mean Square) algorithm) so as to minimize the error signal e output from the microphone 22.

However, since a transfer characteristic C exists in the transmission path between the speaker 16 and the microphone 22, it is necessary to consider this transfer characteristic C when updating the control filter W. The transfer characteristic C also includes electronic circuit characteristics and the like. Therefore, the transfer characteristic C is identified in advance as a filter Cˆ, and the standard signal x corrected by the filter Cˆ is used to update the control filter W. This control system is called a Filtered-X type.

Since the filter Cˆ is a fixed filter identified in advance, a difference may occur between the filter Cˆ and the transfer characteristic C when the transfer characteristic C changes. In this case, the control filter W may diverge due to updating, and there is a risk that noise amplification and/or abnormal noise occur.

Therefore, the present inventors hereof have proposed a method which allows the filter Cˆ to follow the change in the transfer characteristic C during active noise control without the need to identify the transfer characteristic C in advance. The present invention is a further improvement to the method that was already proposed by the present inventors hereof. Now, the outline of an active noise control device 100 using the method already proposed by the present inventors will be described below.

Figure 2:
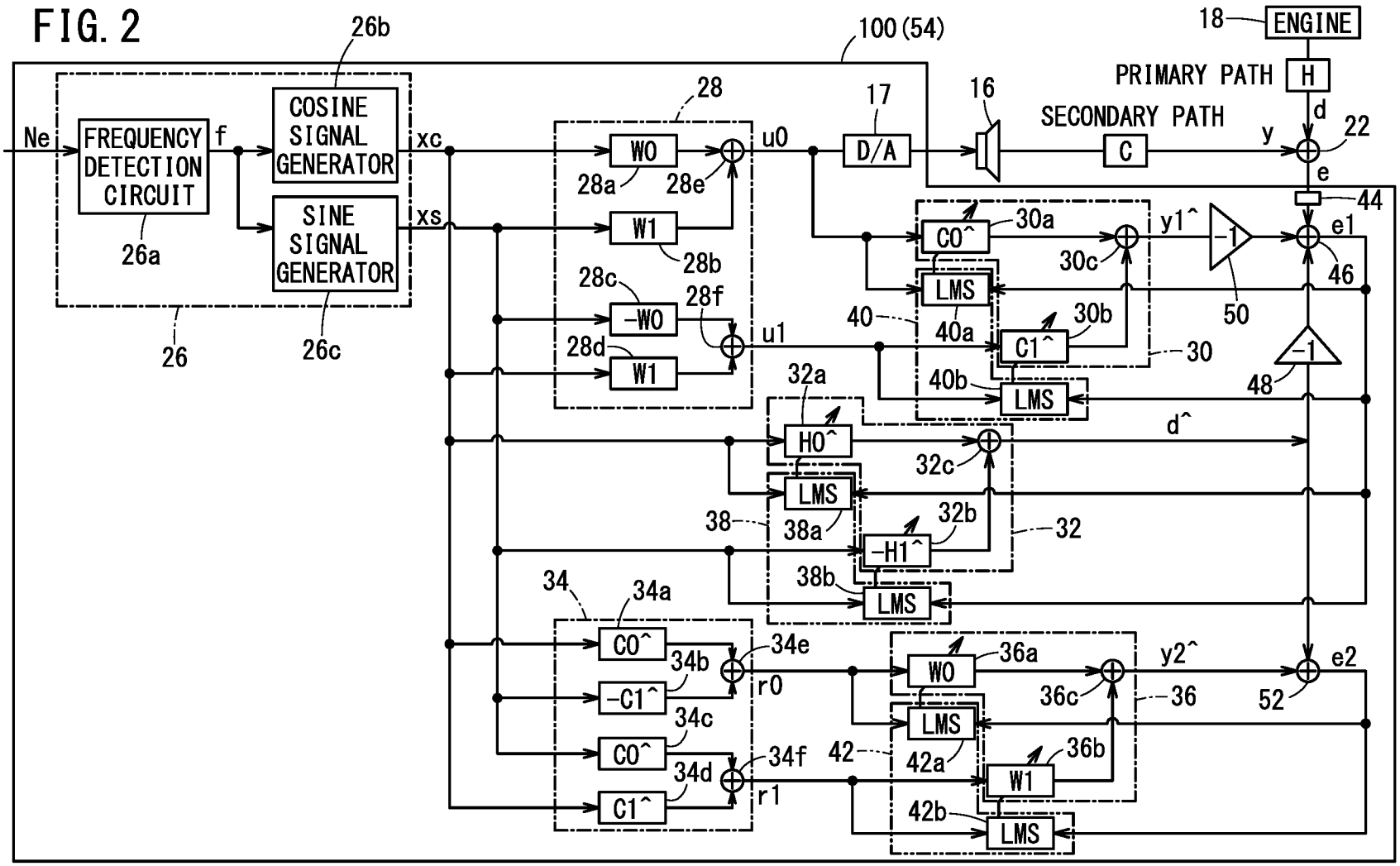
FIG. 2 is a block diagram of an active noise control device.

FIG. 2 is a block diagram of the active noise control device 100 using the method that was already proposed by the present inventors. The transmission path from the engine 18 to the microphone 22 may be referred to hereinbelow as a primary path. Further, the transmission path from the speaker 16 to the microphone 22 may be referred to as a secondary path below.

The active noise control device 100 includes a standard signal generation unit 26, a control signal generation unit 28, a first estimated anti-noise signal generation unit 30, an estimated noise signal generation unit 32, a reference signal generation unit 34, a second estimated anti-noise signal generation unit 36, a primary path filter coefficient updating unit 38, a secondary path filter coefficient updating unit 40 and a control filter coefficient updating unit 42.

The standard signal generation unit 26 generates standard signals xc and xs based on the engine speed Ne. The standard signal generation unit 26 includes a frequency detection circuit 26*a*, a cosine signal generator 26*b* and a sine signal generator 26*c*.

The frequency detection circuit 26*a* detects a control target frequency f. The control target frequency f is the vibration frequency of the engine 18 detected based on the engine speed Ne. The cosine signal generator 26*b* generates a standard signal xc ($=\cos(2\pi ft)$) which is a cosine signal of the control target frequency f. The sine signal generator 26*c* generates a standard signal xs ($=\sin(2\pi ft)$) which is a sine signal of the control target frequency f. Here, t is time.

The control signal generation unit 28 generates control signals u0 and u1 based on the standard signals xc and xs. The control signal generation unit 28 includes a first control filter 28*a*, a second control filter 28*b*, a third control filter 28*c*, a fourth control filter 28*d*, an adder 28*e* and an adder 28*f*.

In the control signal generation unit 28, a SAN filter is used for a control filter W. The control filter W includes a filter W0 for the standard signal xc and a filter W1 for the standard signal xs. The control filter W is optimized by updating a coefficient W0 of the filter W0, and a coefficient W1 of the filter W1, in the control filter coefficient updating unit 42 described later.

The first control filter 28*a* has a filter coefficient W0. The second control filter 28*b* has a filter coefficient W1. The third control filter 28*c* has a filter coefficient −W0. The fourth control filter 28*d* has a filter coefficient W1.

The standard signal xc corrected by the first control filter 28*a* and the standard signal xs corrected by the second control filter 28*b* are added at the adder 28*e* to generate the control signal u0. The standard signal xs corrected by the third control filter 28*c* and the standard signal xc corrected by the fourth control filter 28*d* are added at the adder 28*f* to generate the control signal u1.

The control signal u0 is converted into an analog signal by a digital-to-analog converter 17 and output to the speaker 16. The speaker 16 is controlled based on the control signal u0 and outputs anti-noise sound from the speaker 16.

The first estimated anti-noise signal generation unit 30 generates a first estimated anti-noise signal y1ˆ based on the control signals u0 and u1. The first estimated anti-noise signal generation unit 30 includes a first secondary path filter 30*a*, a second secondary path filter 30*b* and an adder 30*c*.

In the first estimated anti-noise signal generation unit 30, a SAN filter is used for the secondary path filter Cˆ. In the secondary path filter coefficient updating unit 40 detailed later, the complex-valued coefficient (C0ˆ+iC1ˆ where "i" is the imaginary unit) of the secondary path filter Cˆ is updated, whereby the sound transfer characteristic C is identified as the secondary path filter Cˆ.

The first secondary path filter 30*a* has a filter coefficient, C0ˆ, which is the real part of the coefficient of a secondary path filter Cˆ. The second secondary path filter 30*b* has a filter coefficient, C1ˆ, which is the imaginary part of the coefficient of the secondary path filter Cˆ. The control signal u0 corrected by the first secondary path filter 30*a* and the control signal u1 corrected by the second secondary path filter 30*b* are added at the adder 30*c* to generate the first estimated anti-noise signal y1ˆ. The first estimated anti-noise signal y1ˆ is the estimated signal of the signal corresponding to an anti-noise sound y input to the microphone 22.

The estimated noise signal generation unit 32 generates an estimated noise signal dˆ based on the standard signals xc and xs. The estimated noise signal generation unit 32 includes a first primary path filter 32*a*, a second primary path filter 32*b* and an adder 32*c*.

In the estimated noise signal generation unit 32, a SAN filter is used for a primary path filter Hˆ. In the primary path filter coefficient updating unit 38, which will be described later, the complex-valued coefficient (H0ˆ+iH1ˆ where "i" is the imaginary unit) of the primary path filter Hˆ is updated, whereby the transfer characteristic H, of the primary path (hereinafter, referred as the primary path transfer characteristic H) is identified as the primary path filter Hˆ.

The first primary path filter 32*a* has a filter coefficient, H0ˆ, which is the real part of the coefficient of the primary path filter Hˆ. The second primary path filter 32*b* has a filter coefficient −H1ˆ, which is a value obtained by inverting the polarity of the imaginary part of the coefficient of the extraction filter Hˆ. The standard signal xc corrected by the first primary path filter 32*a* and the standard signal xs corrected by the second primary path filter 32*b* are added at the adder 32*c* to generate an estimated noise signal dˆ. The estimated noise signal dˆ is an estimated signal of a signal corresponding to the noise d input to the microphone 22.

The reference signal generation unit 34 generates reference signals r0 and r1 based on the standard signals xc and xs. The reference signal generation unit 34 includes a third secondary path filter 34*a*, a fourth secondary path filter 34*b*, a fifth secondary path filter 34*c*, a sixth secondary path filter 34*d*, an adder 34*e* and an adder 34*f*.

In the reference signal generation unit 34, a SAN filter is used for a secondary path filter Cˆ. In the secondary path filter coefficient updating unit 40 described later, the complex-valued coefficient (C0ˆ+iC1ˆ where "i" is the imaginary unit) of the secondary path filter Cˆ is updated, whereby the transfer characteristic C of the secondary path (hereinafter referred to as the secondary path transfer characteristic C) is identified as the secondary pathway filter Cˆ.

The third secondary path filter 34*a* has a filter coefficient C0ˆ, which is the real part of the coefficient of the secondary path filter Cˆ. The fourth secondary path filter 34*b* has a filter coefficient −C1ˆ, which is a value obtained by inverting the polarity of the imaginary part of the coefficient of the secondary path filter Cˆ. The fifth secondary path filter 34*c* has a filter coefficient C0ˆ, which is the real part of the coefficient of the secondary path filter Cˆ. The sixth secondary path filter 34*d* has a filter coefficient C1ˆ, which is the imaginary part of the coefficient of the secondary path filter Cˆ.

The standard signal xc corrected by the third secondary path filter 34*a* and the standard signal xs corrected by the fourth secondary path filter 34*b* are added at the adder 34*e* to generate the reference signal r0. The standard signal xs corrected by the fifth secondary path filter 34*c* and the standard signal xc corrected by the sixth secondary path filter 34*d* are added at the adder 34*f* to generate the reference signal r1.

The second estimated anti-noise signal generation unit 36 generates a second estimated anti-noise signal y2ˆ based on the reference signals r0 and r1. The second estimated anti-noise signal generation unit 36 includes a fifth control filter 36*a*, a sixth control filter 36*b* and an adder 36*c*.

In the second estimated anti-noise signal generation unit 36, a SAN filter is used for a control filter W. The fifth control filter 36*a* has a filter coefficient W0. The sixth control filter 36*b* has a filter coefficient W1.

The reference signal r0 corrected by the fifth control filter 36*a* and the reference signal r1 corrected by the sixth control filter 36*b* are added at the adder 36*c* to generate the second estimated anti-noise signal y2ˆ. The second estimated anti-noise signal y2ˆ is an estimated signal of a signal corresponding to the anti-noise sound y input to the microphone 22.

An analog-digital converter 44 converts the error signal e output from the microphone 22 from an analog signal to a digital signal.

The error signal e is input to an adder 46. The estimated noise signal dˆ generated by the estimated noise signal generation unit 32 passes through an inverter 48 where its polarity is inverted and then the inverted signal is input to the adder 46. The first estimated anti-noise signal y1ˆ generated by the first estimated anti-noise signal generation unit 30 passes through an inverter 50 where its polarity is inverted and then the inverted signal is input to the adder 46. In the adder 46, a first virtual error signal e1 is generated. The adder 46 corresponds to the first virtual error signal generation unit of the present invention.

The estimated noise signal dˆ generated by the estimated noise signal generation unit 32 is input to an adder 52. The second estimated anti-noise signal y2ˆ generated by the second estimated anti-noise signal generation unit 36 is input to the adder 52. In the adder 52, a second virtual error signal e2 is generated. The adder 52 corresponds to the second virtual error signal generation unit of the present invention.

The primary path filter coefficient updating unit 38 updates the filter coefficients H0ˆ and H1ˆ, based on the standard signals xc and xs and the first virtual error signal e1. The primary path filter coefficient updating unit 38 updates the filter coefficients H0ˆ and H1ˆ, based on an LMS algorithm. The primary path filter coefficient updating unit 38 includes a first primary path filter coefficient updating unit 38*a* and a second primary path filter coefficient updating unit 38*b*.

The first primary path filter coefficient updating unit 38*a* and the second primary path filter coefficient updating unit 38*b* update the filter coefficients H0ˆ and H1ˆ based on the following equations. In the equations, n is a time step (n=0, 1, 2, . . . ), and μ0 and μ1 are step size parameters.

$$H0\hat{}_{n+1}=H0\hat{}_{n}-\mu 0\times e1_{n}\times xc_{n}$$

$$H1\hat{}_{n+1}=H1\hat{}_{n}-\mu 1\times e1_{n}\times xs_{n}$$

In the primary path filter coefficient updating unit 38, the filter coefficients H0ˆ and H1ˆ are repeatedly updated, so that the primary path transfer characteristic H is identified as the primary path filter Hˆ. In the active noise control device 100 using SAN filters, the updating formulae of the coefficients of the primary path filter Hˆ are defined by four arithmetic operations and include no convolution operation. Therefore, the calculation load due to the updating process of the filter coefficients H0ˆ and H1ˆ can be reduced.

The secondary path filter coefficient updating unit 40 updates the filter coefficients C0ˆ and C1ˆ based on the control signals u0 and u1 and the first virtual error signal e1. The secondary path filter coefficient updating unit 40 updates the filter coefficients C0ˆ and C1ˆ based on the LMS algorithm. The secondary path filter coefficient updating unit 40 includes a first secondary path filter coefficient updater 40*a* and a second secondary path filter coefficient updater 40*b*.

The first secondary path filter coefficient updater 40*a* and the second secondary path filter coefficient updater 40*b* update the filter coefficients C0ˆ and C1ˆ based on the following equations, where μ2 and μ3 are step size parameters.

$$C0\hat{}_{n+1}=C0\hat{}_{n}-\mu 2\times e1_{n}\times u0_{n}$$

$$C1\hat{}_{n+1}=C1\hat{}_{n}-\mu 3\times e1_{n}\times u1_{n}$$

In the secondary path filter coefficient updating unit 40, the filter coefficients C0ˆ and C1ˆ are repeatedly updated, so that the secondary path transfer characteristic C is identified as the secondary path filter Cˆ. In the active noise control device 100 using SAN filters, the updating formulae of the filter coefficients C0ˆ and C1ˆ are defined by four arithmetic operations and include no convolution operation. Therefore, the calculation load due to the updating process of the filter coefficients C0ˆ and C1ˆ can be reduced.

The control filter coefficient updating unit 42 updates the filter coefficients W0 and W1, based on the reference signals r0 and r1 and the second virtual error signal e2. The control filter coefficient updating unit 42 updates the filter coefficients W0 and W1, based on an LMS algorithm. The control filter coefficient updating unit 42 includes a first control filter coefficient updater 42*a* and a second control filter coefficient updater 42*b*.

The first control filter coefficient updater 42*a* and the second control filter coefficient updater 42*b* update the filter coefficients W0 and W1, based on the following equations, where μ4 and μ5 are step size parameters.

$$W0_{n+1}=W0_{n}-\mu 4\times e2_{n}\times r0_{n}$$

$$W1_{n+1}=W1_{n}-\mu 5\times e2_{n}\times r1_{n}$$

In the control filter coefficient updating unit 42, the filter coefficients W0 and W1 are repeatedly updated so as to optimize the control filter W. In the active noise control device 100 using SAN filters, the updating formulae of the filter coefficients W0 and W1 are defined by four arithmetic operations and include no convolution operation. Therefore, the calculation load due to the updating process of the filter coefficients W0 and W1 can be reduced.

Improvements

The improvements of the present invention to the active noise control device 100 that uses the above method already proposed by the present inventors will be described.

Figure 3:
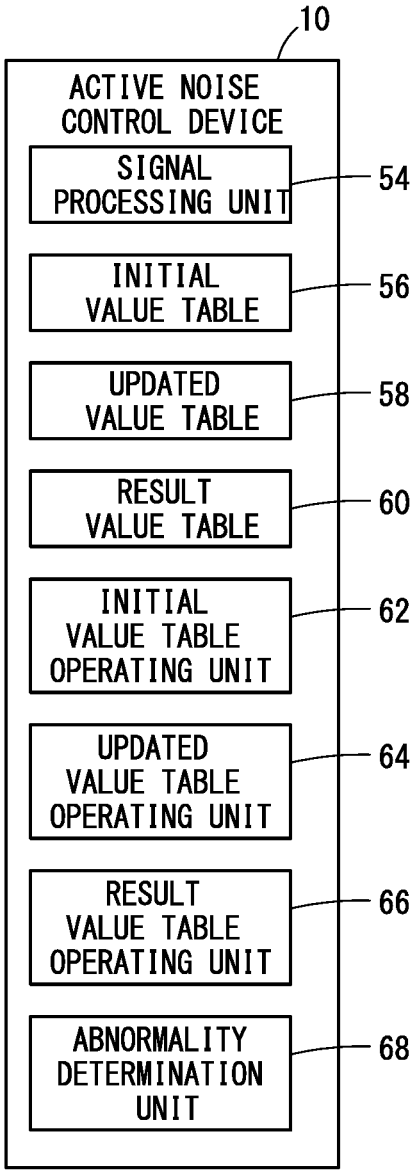
FIG. 3 is a block diagram of the active noise control device.

FIG. 3 is a block diagram of the active noise control device 10 of the present embodiment. The active noise control device 10 of the present embodiment includes the active noise control device 100 that uses the method already proposed by the present inventors, as a signal processing unit 54. The active noise control device 10 further includes an initial value table 56, an updated value table 58, a result value table 60, an initial value table operating unit 62, an updated value table operating unit 64, a result value table operating unit 66, and an abnormality determination unit 68.

The active noise control device 10 has an arithmetic processing unit and a storage (not shown). The arithmetic processing unit includes, for example, a processor such as a central processing unit (CPU), a microprocessing unit (MPU), and memory devices of non-transitory or transitory tangible computer-readable recording media such as ROM or RAM. The storage is, for example, a non-transitory tangible computer-readable recording medium such as a hard disk or flash memory.

The initial value table 56 is a table-format memory area provided in a ROM, and the initial values of the filter coefficients C0ˆ and C1ˆ of the secondary path filter Cˆ described later are stored therein. The updated value table 58 is a table-format memory area provided in a RAM, and the updated values of the filter coefficients C0ˆ and C1ˆ are stored therein. The result value table 60 is a table-format memory area provided in a ROM, and the result values of the filter coefficients C0ˆ and C1ˆ are stored therein.

The initial value table operating unit 62 performs writing or the like of the initial values to the initial value table 56. The updated value table operating unit 64 performs writing or the like of the updated values to the updated value table 58. The result value table operating unit 66 performs writing or the like of the result values to the result value table 60. When the active noise control ends, the abnormality determination unit 68 determines whether an abnormality or divergence has occurred in the active noise control. The abnormality determination unit 68 corresponds to the determination unit of the present invention.

The signal processing unit 54, the initial value table operating unit 62, the updated value table operating unit 64, the result value table operating unit 66, and the abnormality determination unit 68 are realized by the arithmetic processing implemented by the arithmetic processing unit according to programs stored in the storage.

The updating process on the filter coefficients C0ˆ and C1ˆ in the secondary path filter coefficient updating unit 40 of the present embodiment partially differs from the updating process on the filter coefficients C0ˆ and C1ˆ in the secondary path filter coefficient updating unit 40 of the above-described active noise control device 100.

In the secondary path filter coefficient updating unit 40 of the active noise control device 100 that uses the method already proposed, the following equations are used to update the filter coefficients C0ˆ and C1ˆ, in the first secondary path filter coefficient updater 40*a* and the second secondary path filter coefficient updater 40*b*.

$$C0\hat{}_{n+1}=C0\hat{}_{n}-\mu 2\times e1_{n}\times u0_{n}$$

$$C1\hat{}_{n+1}=C1\hat{}_{n}-\mu 3\times e1_{n}\times u1_{n}$$

On the other hand, in the secondary path filter coefficient updating unit 40 of the active noise control device 10 (the signal processing unit 54) of the present embodiment, the filter coefficients C0ˆ and C1ˆ are updated based on the following equations, in the first secondary path filter coefficient updater 40*a* and the second secondary path filter coefficient updater 40*b*.

$$C0\hat{}(f)_{n+1}=C0\hat{}(f)_u_{n}-\mu 2\times e1_{n}\times u0_{n}$$

$$C1\hat{}(f)_{n+1}=C1\hat{}(f)_u_{n}-\mu 3\times e1_{n}\times u1_{n}$$

The updated values corresponding to the respective control target frequencies f stored in the updated value table 58 are input into the coefficients C0ˆ(f)_u and C1ˆ(f)_u in the above equation. Hereinafter, the first term on the right side of each of the updating formulae of the filter coefficients C0ˆ and C1ˆ may be referred to as a previous value.

In the method already proposed, the updated filter coefficients $C0\hat{}_{n}$ and $C1\hat{}_{n}$, updated in the previous time (time step n), are used as the previous values for the updating formulae. That is, even when the control target frequency f changes in a period from the previous updating (in time step n) to the current updating (in time step n+1), the previously updated filter coefficients $C0\hat{}_{n}$ and $C1\hat{}_{n}$ are used as the previous values for the updating formulae.

On the other hand, in the present embodiment, as the previous values for the updating formulae, the updated values corresponding to the control target frequency f at the time of the current updating (in time step n+1) are used. That is, the filter coefficients C0ˆ(f)_u and C1ˆ(f)_u that have been updated latest for the control target frequency f are used as the previous values for the updating formulae. That is, the previous values are not necessarily those that were updated at the previous time (in time step n).

Further, the secondary path filter coefficient updating unit 40 copies the updated filter coefficients C0ˆ and C1ˆ to the third secondary path filter 34*a*, the fourth secondary path filter 34*b*, the fifth secondary path filter 34*c*, and the sixth secondary path filter 34*d* in the reference signal generation unit 34.

Updating of Coefficients of Secondary Path Filter

Figure 4:
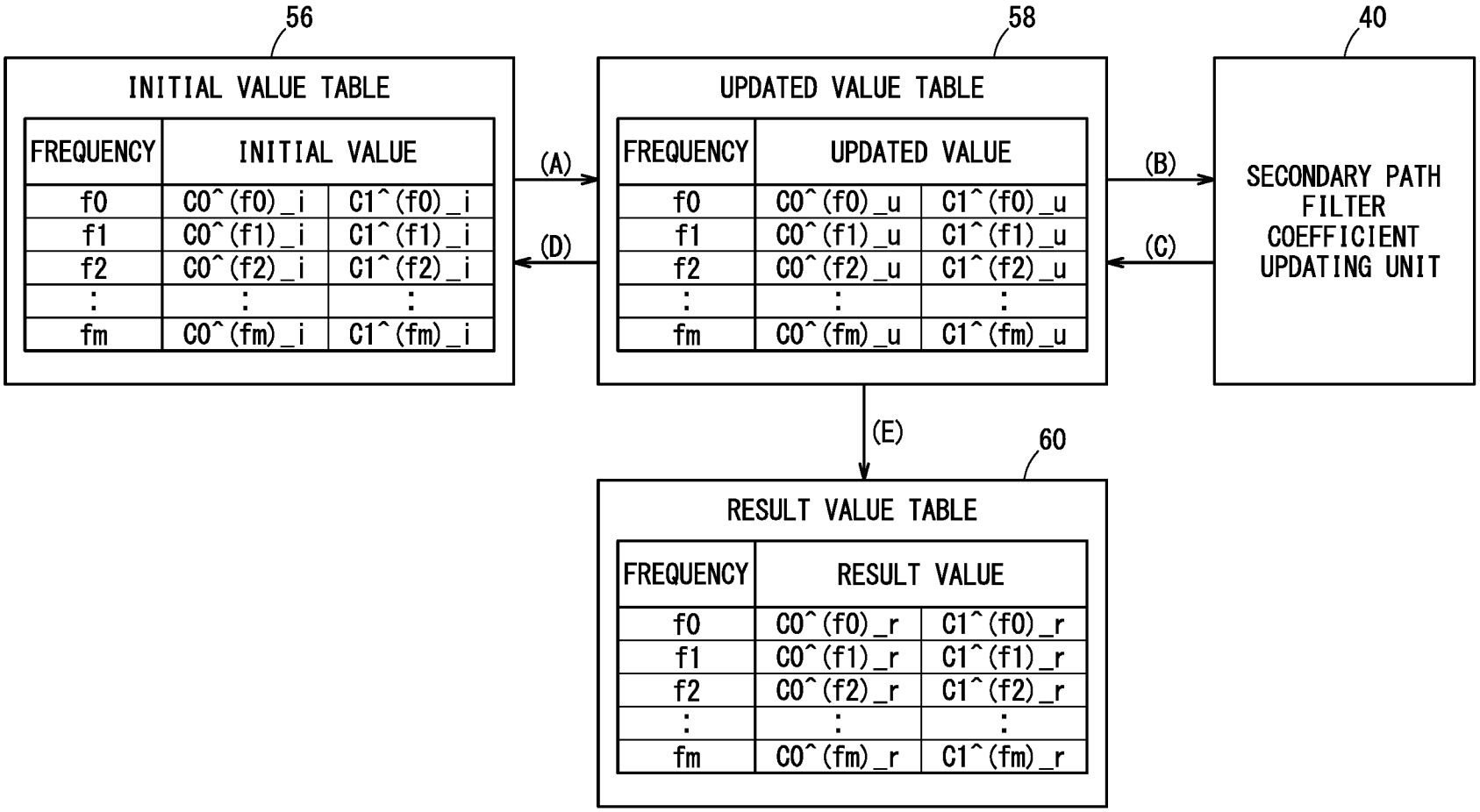
FIG. 4 is a diagram for explaining the updating of filter coefficients.

FIG. 4 is a diagram for explaining the updating of the filter coefficients C0ˆ and C1ˆ. As shown in FIG. 4, the initial value table 56 stores the initial values C0ˆ(f)_i and C1ˆ(f)_i, in a table format, in association with a frequency. The updated value table 58 stores the updated values C0ˆ(f)_u and C1ˆ(f)_u, in a table format, in association with the frequency. Further, the result value table 60 stores the result values C0ˆ(f)_r and C1ˆ(f)_r in a table format in association with the frequency.

The initial values corresponding to each frequency stored in the initial value table 56 are set to any of the following (i) to (v):

(i) measurement values of the secondary path transfer characteristic C at each frequency;

(ii) phase information of the measurement values of the secondary path transfer characteristic C at each frequency;

(iii) estimated values of the secondary path transfer characteristic C obtained by interpolation from the measurement values of the secondary path transfer characteristic C at typical frequencies, or phase information of the estimated values of the secondary path transfer characteristic C;

(iv) estimated values of the secondary path transfer characteristic C estimated by the following equations:

$$C0\hat{}(f)=a(f)\times\cos(-2\pi fT)$$

$$C1\hat{}(f)=a(f)\times\sin(-2\pi fT)$$

where T is the time from when sound is emitted from the speaker 16 to when the sound reaches the microphone 22, and a is the amplitude constant; and (v) convenient small values (when the initial values are not particularly set for convenience such as for system setting efficiency or the like).

Figure 5:
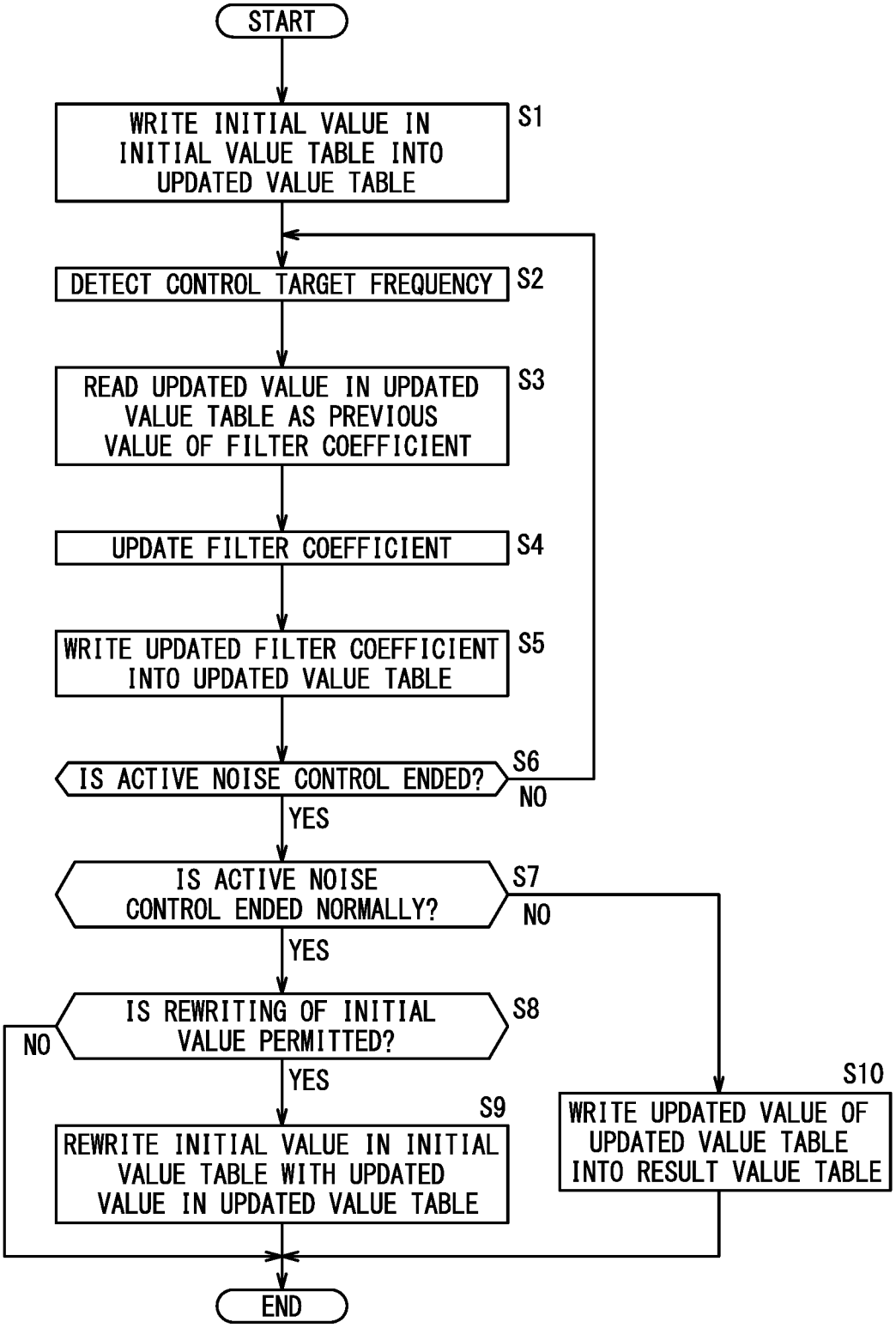
FIG. 5 is a flowchart showing the flow of a filter coefficient update process.

FIG. 5 is a flowchart showing the flow of an updating process of the filter coefficients C0ˆ and C1ˆ. The updating process of the filter coefficients C0ˆ and C1ˆ is executed every time the active noise control is performed.

At step S1, the updated value table operating unit 64 writes the initial values corresponding to each frequency in the initial value table 56 as the updated values corresponding to each frequency in the updated value table 58 ((A) in FIG. 4), then the process proceeds to step S2.

At step S2, the frequency detection circuit 26*a* of the signal processing unit 54 detects the control target frequency f, and the process proceeds to step S3.

At step S3, the secondary path filter coefficient updating unit 40 reads the updated values corresponding to the control target frequency f as the previous values ((B) in FIG. 4), and the process proceeds to step S4.

At step S4, the secondary path filter coefficient updating unit 40 updates the filter coefficients C0ˆ and C1ˆ, and the process proceeds to step S5.

At step S5, the updated value table operating unit 64 writes the updated filter coefficients C0ˆ and C1ˆ as the updated values corresponding to the control target frequency f ((C) in FIG. 4), and the process proceeds to step S6

At step S6, the abnormality determination unit 68 determines whether or not the active noise control has been ended. The active noise control ends when the engine 18 stops, when an abnormality has occurred in the active noise control, or when divergence has occurred in the active noise control. When the active noise control is not ended, the process returns to step S2. When the active noise control has been ended, the process proceeds to step S7.

At step S7, the abnormality determination unit 68 determines whether or not the active noise control has ended normally. When it is determined that the active noise control has ended normally, the process proceeds to step S8. When it is determined that the active noise control has not ended normally due to an abnormality or divergence of the active noise control, the process proceeds to step S10.

At step S8, the initial value table operating unit 62 determines whether or not rewriting of the initial values of the initial value table 56 is permitted. When rewriting of the initial value table 56 is permitted, the process proceeds to step S9. When rewriting of the initial value table 56 is not permitted, the updating process of the filter coefficients C0ˆ and C1ˆ is terminated.

At step S9, the initial value table operating unit 62 rewrites the initial values corresponding to each frequency in the initial value table 56 with the updated values corresponding to the frequency in the updated value table 58 ((D) in FIG. 4), and the updating process of the filter coefficients C0ˆ and C1ˆ is terminated.

At step S10, the result value table operating unit 66 writes the updated values corresponding to each frequency of the updated value table 58, as the result values corresponding to the frequency, into the result value table 60 ((E) in FIG. 4), and the updating process of the filter coefficients C0ˆ and C1ˆ is terminated.

The initial value table 56 and the result value table 60 can be copied to a personal computer or the like connected to the vehicle 12. Therefore, when an abnormality or divergence occurs in the active noise control, it is possible to investigate and verify the cause of the occurrence of the abnormality or divergence in the active noise control by comparing the updated values stored in the initial value table 56 with the result values stored in the result value table 60.

Experimental Result

The present inventors conducted experiments on noise reduction performance of active noise control. The experimental results will be shown below. Each of the following experiments was performed under a secondary path transfer characteristic C having a gain characteristic shown by the thin line in FIG. 6A and a phase characteristic shown by the thin line in FIG. 6B.

Experiment (1)

In experiment (1), the sound pressure level of the noise in the vehicle passenger compartment 14 is measured when the vehicle 12 is accelerated from the stopped state while active noise control is off.

Experiment (2)

In experiment (2), the sound pressure level of the noise in the vehicle passenger compartment 14 is measured when the vehicle 12 is accelerated from the stopped state while active noise control is being performed by the active noise control device 100 that uses the method already proposed by the present inventors.

Experiment (3)

In experiment (3), the sound pressure level of the noise in the vehicle passenger compartment 14 is measured when the vehicle 12 is accelerated from the stopped state while active noise control is being performed by the active noise control device 10 of the present embodiment. In experiment (3), the initial values at each frequency in the initial value table 56 are set to the measured values of the secondary path transfer characteristic C of the frequency.

Experiment (4)

In experiment (4), the sound pressure level of the noise in the vehicle passenger compartment 14 is measured when the vehicle 12 is accelerated from the stopped state while active noise control is being performed by the active noise control device 10 of the present embodiment. In experiment (4), the initial values at each frequency in the initial value table 56 is set to the estimated values of the secondary path transfer characteristic C estimated by the following equations.

$$C0\hat{}(f)=\cos(-2\pi fT)$$

$$C1\hat{}(f)=\sin(-2\pi fT)$$

where T is set to 0.01 seconds. The gain characteristic and phase characteristic of the estimated values of the secondary path transfer characteristic C are shown by the thick lines in FIGS. 6A and 6B.

Comparison of Results of Experiments (1) to (3)

Figure 7:
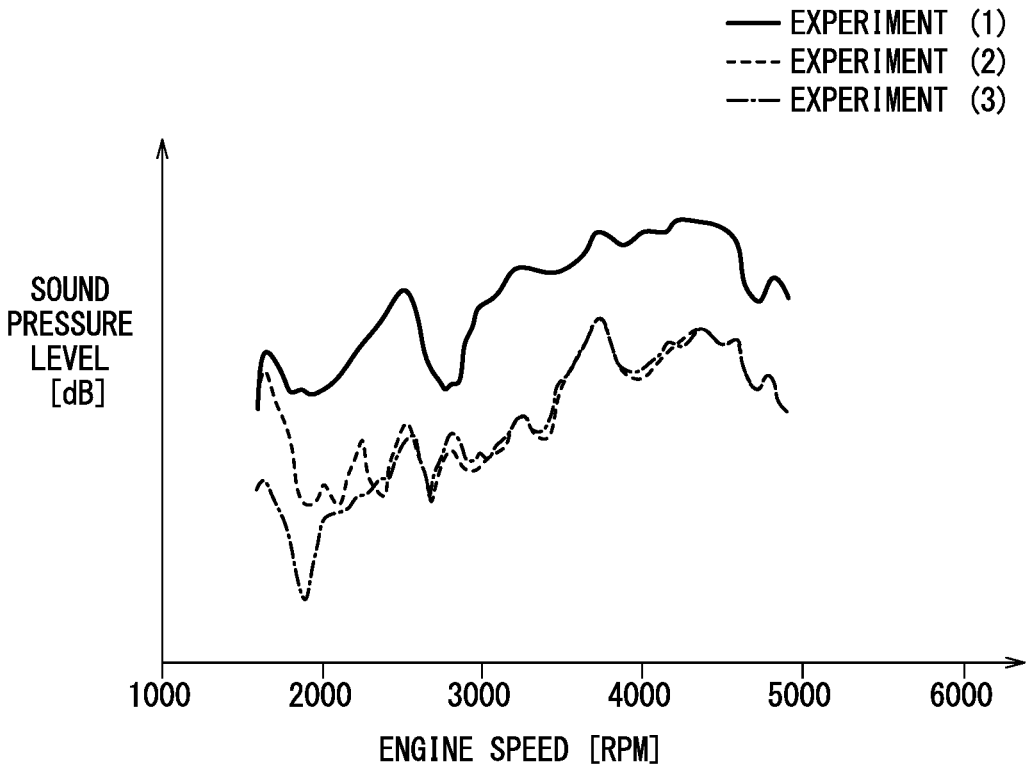
FIG. 7 is a graph showing the sound pressure levels of noise in the vehicle passenger compartment.

FIG. 7 is a graph showing the sound pressure levels of the noise in the vehicle passenger compartment 14, measured in the experiments (1) to (3).

As shown in FIG. 7, at the start of driving the vehicle 12 (at the engine speed of 1600 RPM to 2000 RPM), the noise reduction performance in experiment (3) is higher than that in experiment (2) by 10 dB or more. In particular, at the time right after the start of driving the vehicle 12 (at the engine speed of around 1600 RPM), the noise was not reduced in experiment (2), whereas the noise was reduced by about 10 dB in experiment (3).

Comparison of Results of Experiments (1), (2) and (4)

Figure 8:
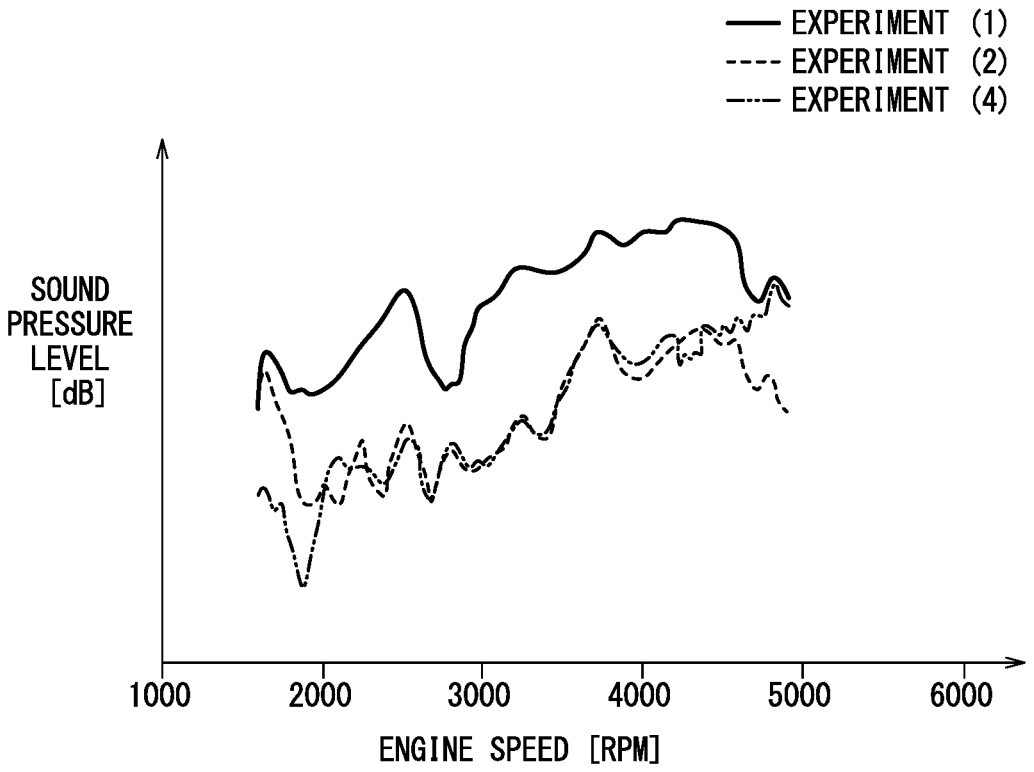
FIG. 8 is a graph showing the sound pressure levels of noise in the vehicle passenger compartment.

FIG. 8 is a graph showing the sound pressure level of the noise in the vehicle passenger compartment 14, measured in the experiments (1), (2) and (4).

Figure 6A:
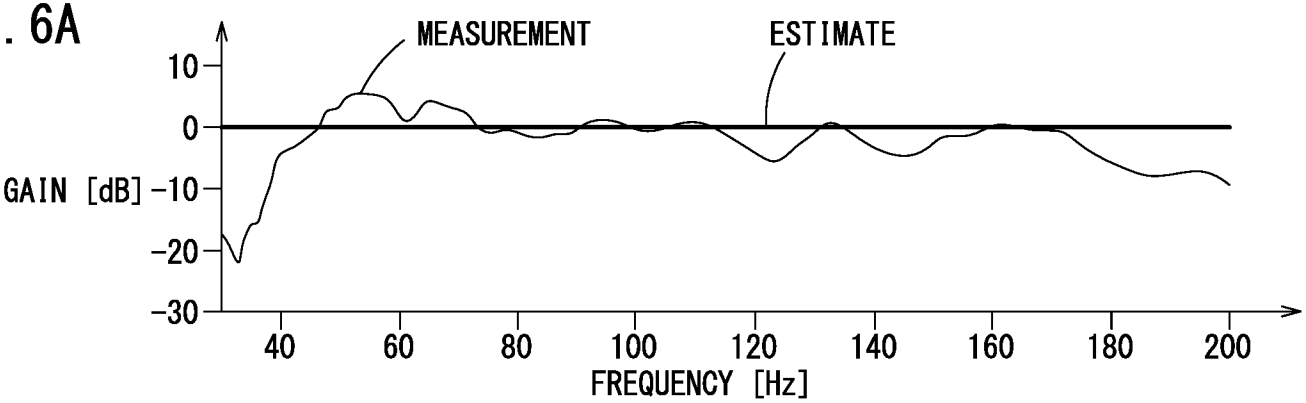
FIG. 6A is a diagram showing gain characteristics of a secondary path transfer characteristic.
Figure 6B:
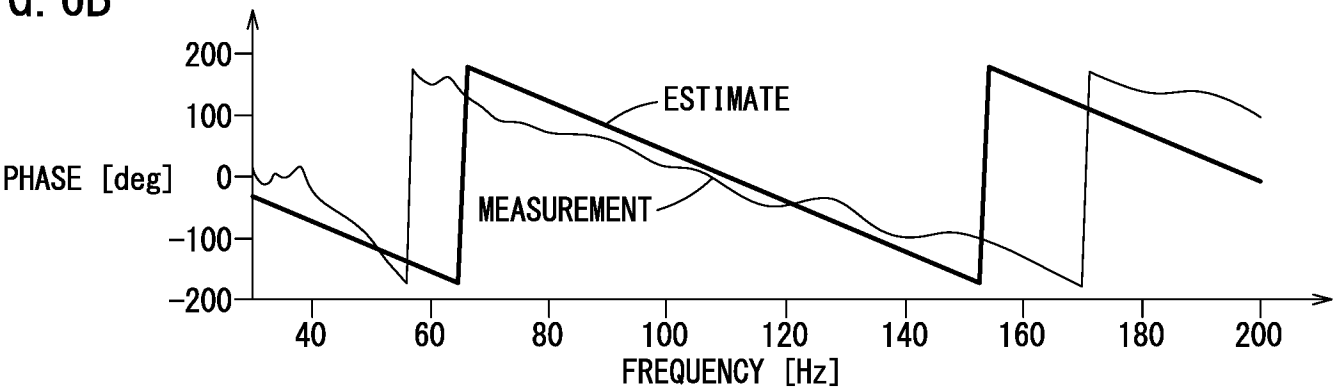
FIG. 6B is a diagram showing phase characteristics of the secondary path transfer characteristic.

As shown in FIG. 8, even when an accurate estimate of the secondary path transfer characteristic C cannot be obtained as in experiment (4), the noise reduction performance in experiment (4) is about the same as or higher than that of experiment (2), in the engine speed range of 4500 RPM or lower. The noise reduction performance in the engine speed range exceeding 4500 RPM, the noise reduction performance in experiment (4) is lower than that in experiment (2). This is because, as shown in FIGS. 6A and 6B, the estimate of the secondary path transfer characteristic C deviates from the actual secondary path transfer characteristic C in the range where the frequency exceeds 150 Hz, which corresponds to the engine speed of 4500 RPM. However, by repeating the updating of the filter coefficients C0ˆ and C1ˆ, the secondary path filter Cˆ approaches the secondary path transfer characteristic C, so that the noise reduction performance is improved.

Experiment (5)

In experiment (5), the sound pressure level of the noise in the vehicle passenger compartment 14 is measured during the first driving when the vehicle 12 is accelerated from the stopped state while active noise control is being performed by the active noise control device 10 of the present embodiment. In experiment (5), the initial values at each frequency in the initial value table 56 are set to convenient small values.

Experiment (6)

In experiment (6), the sound pressure level of the noise in the vehicle passenger compartment 14 is measured during the third driving when the vehicle 12 is accelerated from the stopped state while active noise control is being performed by the active noise control device 10 of the present embodiment. In experiment (6), the initial values at each frequency in the initial value table 56 are set to convenient small values.

Comparison of Results of Experiments (1), (5) and (6)

Figure 9:
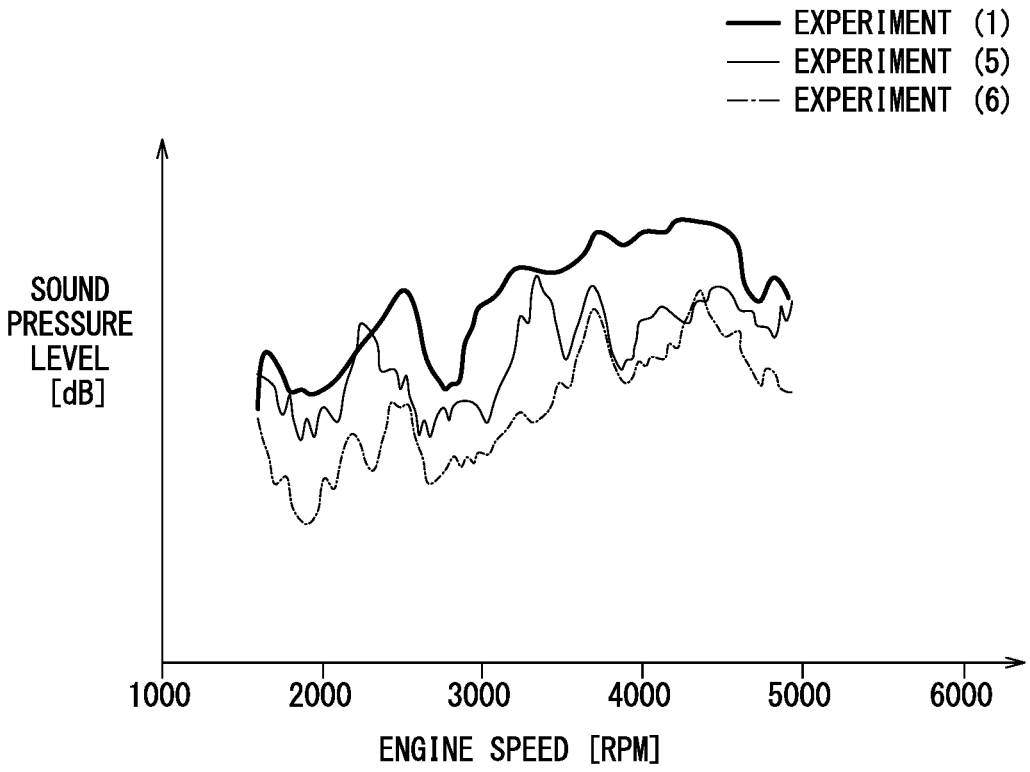
FIG. 9 is a graph showing the sound pressure levels of noise in the vehicle passenger compartment.

FIG. 9 is a graph showing the sound pressure levels of the noise in the vehicle passenger compartment 14, measured in the experiments (1), (5) and (6).

As shown in FIG. 9, the sound pressure level during the first driving in experiment (5) exceeds, in part, the sound pressure level in experiment (1) in which active noise control is off. However, as in experiment (6), the noise reduction performance is improved even with a relatively small number of updates of the filter coefficients C0ˆ and C1ˆ, or during the third driving.

Figure 10:
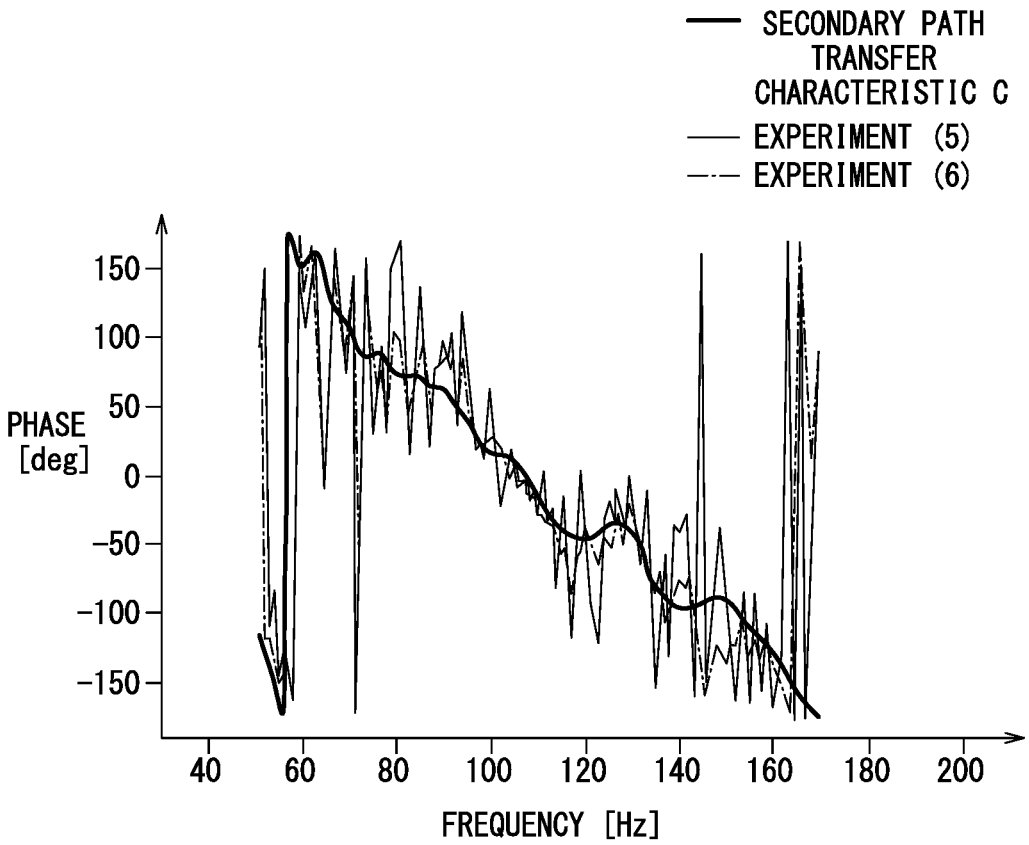
FIG. 10 is a graph showing phase characteristics of updated values.

FIG. 10 shows the phase characteristic of the secondary path transfer characteristic C, the phase characteristic of the updated value after the end of the first driving in experiment (5), and the phase characteristic of the updated value after the end of the third driving in experiment (6).

As shown in FIG. 10, there is a tendency that random errors, which are large with the updated values after the end of the first driving, converge toward the secondary path transfer characteristic C with the updated values after the end of the third driving. Since the secondary path filter coefficient updating unit 40 rewrites the initial values in the initial value table 56 with the updated filter coefficients C0ˆ and C1ˆ, it is possible to update the filter coefficients C0ˆ and C1ˆ with the highly accurate initial values at the next start of active noise control. Therefore, it is possible to improve the noise reduction performance by the active noise control.

Operation and Effect

In the active noise control device 10 of the present embodiment, the initial value table 56 stores the initial values C0ˆ(f)_i and C1ˆ(f)_i in association with the frequency, in a table format. The initial values corresponding to each frequency stored in the initial value table 56 is set to any of the following (i) to (v):

(i) measurement values of the secondary path transfer characteristic C at each frequency;

(ii) phase information of the measurement values of the secondary path transfer characteristic C at each frequency;

(iii) estimated values of the secondary path transfer characteristic C obtained by interpolation based on the measurement values of the secondary path transfer characteristic C at typical frequencies, or phase information of the estimated values of the secondary path transfer characteristic C;

(iv) the estimated values of the secondary path transfer characteristic C estimated by the following equations:

$$C0\hat{}(f)=a(f)\times\cos(-2\pi fT)$$

$$C1\hat{}(f)=a(f)\times\sin(-2\pi fT)$$

where T is the time from when sound is emitted from the speaker 16 to when the sound reaches the microphone 22, and a is the amplitude constant; and (v) convenient small values (when the initial values are not particularly set for convenience such as for system setting efficiency or the like).

Further, the updated value table operating unit 64 writes the initial values corresponding to the control target frequency f in the initial value table 56 to the updated values corresponding to the control target frequency f in the updated value table 58 at the start of active noise control. The secondary path filter coefficient updating unit 40 reads the updated values corresponding to the control target frequency f from the updated value table 58 before updating the filter coefficients C0ˆ and C1ˆ. Then, the secondary path filter coefficient updating unit 40 updates the filter coefficients C0ˆ and C1ˆ by using the read updated values as the previous values. The updated value table operating unit 64 writes the updated filter coefficients C0ˆ and C1ˆ to the updated values corresponding to the control target frequency f in the updated value table 58. Provision of the initial value table 56 and the updated value table 58 enables the active noise control device 10 to set the initial values of the filter coefficients C0ˆ and C1ˆ for each frequency, and also update the filter coefficients C0ˆ and C1ˆ for each frequency. With such a configuration, the active noise control device 10 can significantly improve the initial noise reduction performance, especially after the start of active noise control.

Further, in the active noise control device 10 of the present embodiment, when the abnormality determination unit 68 determines that the active noise control has ended without abnormality or divergence, the initial value table operating unit 62 rewrites the initial values in the initial value table 56 with the updated values of the updated value table 58. With such a configuration, at the next start of active noise control, the filter coefficients C0ˆ and C1ˆ can be updated using highly accurate initial values, whereby it is possible to improve the noise reduction performance of the active noise control.

Further, in the active noise control device 10 of the present embodiment, when the abnormality determination unit 68 determines that the active noise control has ended with abnormality or divergence, the initial value table operating unit 62 does not rewrite the initial values of the initial value table 56 with the updated values of the updated value table 58. With such a configuration, at the next active noise control, the filter coefficients C0ˆ and C1ˆ at the time when abnormality or divergence occurred in the active noise control are not written as the updated values in the updated value table 58, so that the active noise control can be returned to normal.

Further, in the active noise control device 10 of the present embodiment, when the abnormality determination unit 68 determines that the active noise control has ended with abnormality or divergence, the result value table operating unit 66 rewrites the result values in the result value table 60 with the updated values of the updated value table 58. With such a configuration, when an abnormality or divergence occurs in the active noise control, it is possible to investigate and verify the cause of the occurrence of the abnormality or divergence in the active noise control by comparing the updated values stored in the initial value table 56 with the result values stored in the result value table 60.

Second Embodiment

In the active noise control device 10 of this embodiment, the filter coefficients C0ˆ and C1ˆ updated based on the updating formulae in the secondary path filter coefficient updating unit 40 and the updated values stored in the updated value table 58 are subjected to weighted averaging.

The first secondary path filter coefficient updater 40*a* and the second secondary path filter coefficient updater 40*b* perform weighted averaging of the filter coefficients C0ˆ and C1ˆ based on the following equations. In the equations, L is the frequency range for weighted averaging, and θ is a weight coefficient.

$$C0\hat{}(f)_{n+1}=\Sigma_{i=f-L}^{f+L}\theta(i)\times C0\hat{}(i)_u$$

$$C1\hat{}(f)_{n+1}=\Sigma_{i=f-L}^{f+L}\theta(i)\times C1\hat{}(i)_u$$

The weight coefficient θ is defined based on the following equation.

$$\text{If } i = f,\ \theta(f) = \beta,\ \text{else } \theta(i) = \frac{1-\beta}{2L}$$

Random Error Reduction Principle

By repeating the updating of the filter coefficients C0ˆ and C1ˆ, the random error of the secondary path filter C becomes small, and the noise reduction performance by active noise control is improved. In the present embodiment, the weighted averaging is performed on the filter coefficients C0ˆ and C1ˆ updated based on the updating formulae and the updated values stored in the updated value table 58, whereby it is possible to reduce the random error of the secondary path filter Cˆ with a small number of updates.

The filter coefficients C0ˆ and C1ˆ are represented by the following formulae in a combination of a true value and errors.

$$C0\hat{}(f)_n = E[C0\hat{}(f)] + \sigma 0(f)_n + \delta 0(f)_n$$

$$C1\hat{}(f)_n = E[C1\hat{}(f)] + \sigma 1(f)_n + \delta 1(f)_n$$

where E[C0ˆ(f)] is the expected value of C0ˆ, E[C1ˆ(f)] is the expected value of C1ˆ, σ is a system error, and δ is a random error. The expected value E[C0ˆ(f)] and the expected value E[C1ˆ(f)] are values that do not vary with time.

Now, if the system error σ is omitted, the filter coefficient C0ˆ is rewritten as the following equation.

$$C0\hat{}(f)_{n+1} = \frac{1-\beta}{2L}\sum_{i=f-L}^{f+l}(E[C0\hat{}(i)] + \delta 0(i)_n) + \left(\beta - \frac{1-\beta}{2L}\right)(E[C0\hat{}(f)] + \delta 0(f)_n) - \beta \times \mu 2 \times e1_n \times u0_n$$

When the frequency range L for weighted averaging is sufficiently large, the random error δ satisfies the following equation.

$$\Sigma_{i=f-L}^{f+L}\delta 0(i)_n = 0$$

Therefore, the filter coefficient C0ˆ can be further rewritten into the following equation.

$$C0\hat{}(f)_{n+1} = E[C0\hat{}(f)] + \sigma M0(f) + \left(\beta - \frac{1-\beta}{2L}\right)\delta 0(f)_n - \beta \times \mu 2 \times e1_n \times u0_n$$

$$\sigma M0(f) = \frac{1-\beta}{2L}\sum_{i=f-L, i\neq f}^{f+l} E[C0\hat{}\,i] - (1-\beta)E[C0\hat{}(f)]$$

where σM0 is a system error caused by the averaging process, and the closer to 1 the value of β is, the smaller the magnitude of σM0. The random error δ is represented by the following equation using the random error δ when the time step is n=1.

$$\delta 0(f)_{n+1} = \left(\beta - \frac{1-\beta}{2L}\right)\delta 0(f)_n = \left(\beta - \frac{1-\beta}{2L}\right)^n \delta 0(f)_1$$

From this equation, it can be understood that by setting β so as to meet the inequality of 1/(2L)<β<1, the random error δ becomes smaller as the number of updates (time step n) increases. As the number of updates (time step n) increases, the random error δ converges to 0. As a result, the filter coefficient C0ˆ can be represented in a form with no random error δ, as shown in the following equation.

$$C0\hat{}(f)_{n+1} = E[C0\hat{}(f)]$$

Similarly, the filter coefficient C1ˆ can be represented in a form with no random error δ, as shown in the following equation that includes no random error δ.

$$C1\hat{}(f)_{n+1} = E[C1\hat{}(f)]$$

Experimental Result

The present inventors conducted experiments on noise reduction performance by active noise control. The experimental results are shown below. Each of the following experiments was performed under a secondary path transfer characteristic C having a gain characteristic shown by the thin line in FIG. 6A and a phase characteristic shown by the thin line in FIG. 6B.

Experiment (7)

In experiment (7), the sound pressure level of the noise in the vehicle passenger compartment 14 is measured during the third driving when the vehicle 12 is accelerated from the stopped state while active noise control is being performed by the active noise control device 10 of the present embodiment. In experiment (7), the initial values at each frequency in the initial value table 56 are set to convenient small values.

Comparison of Experiments (1), (6) and (7)

Figure 11:
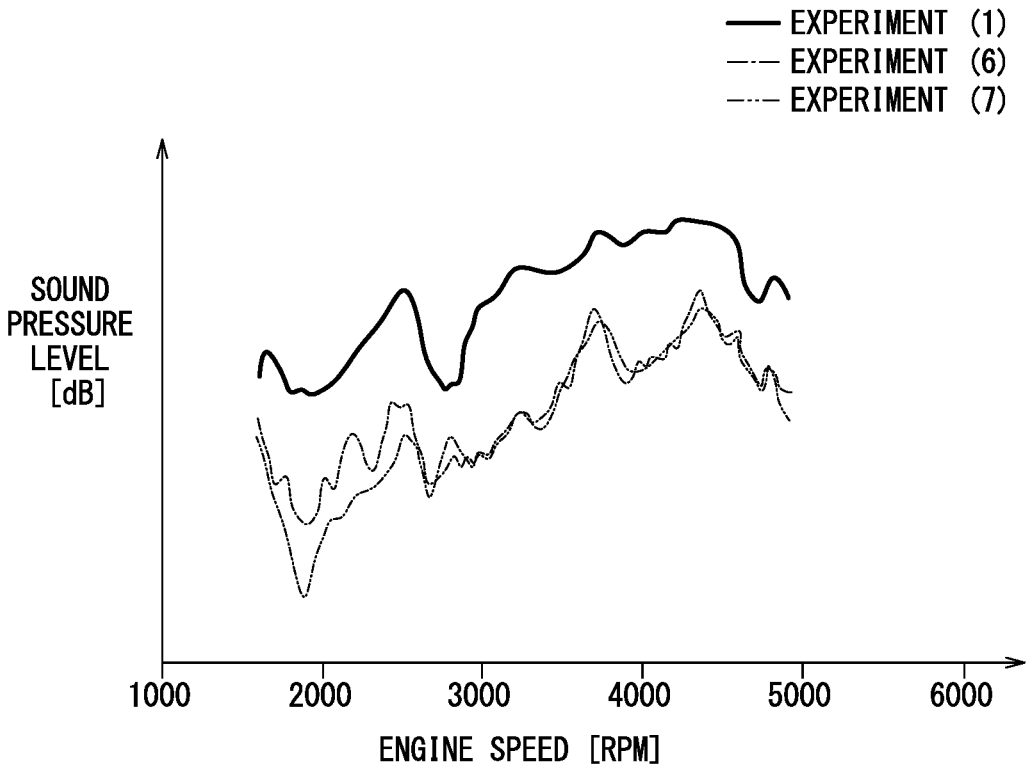
FIG. 11 is a graph showing the sound pressure levels of noise in the vehicle passenger compartment.

FIG. 11 is a graph showing the sound pressure levels of the noise in the vehicle passenger compartment 14, measured in the experiments (1), (6) and (7).

As shown in FIG. 11, in experiment (7), the noise reduction performance is improved at engine speed of 1800 to 2400 RPM by 10 dB or more as compared with experiment (6).

Figure 12:
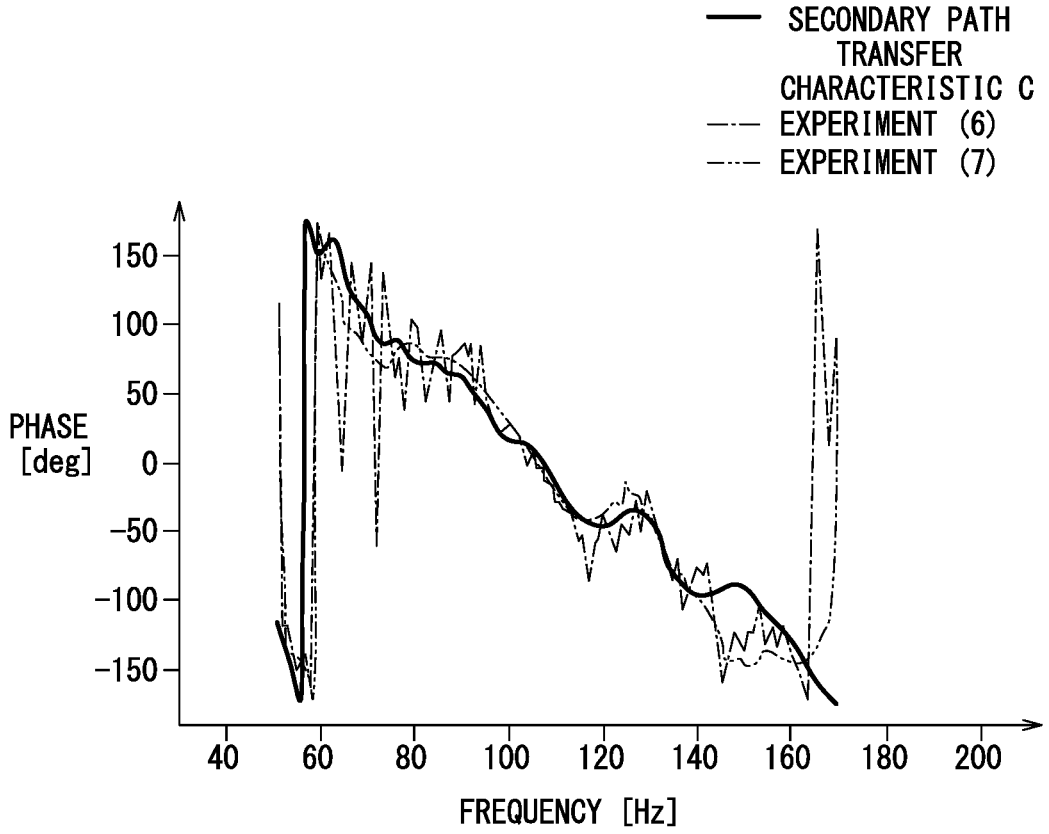
FIG. 12 is a graph showing phase characteristics of updated values.

FIG. 12 shows the phase characteristic of a secondary path transfer characteristic C, the phase characteristic of the updated value after the end of the third driving in experiment (6), and the phase characteristic of the updated value after the end of the third driving in experiment (7). In experiment (7), the random error is greatly reduced as compared with experiment (6) at the frequency of 60 to 80 Hz, which corresponds to the engine speed of 1800 to 2400 RPM.

In each of experiments (6) and (7), driving was performed three times. It can be understood from FIGS. 11 and 12 that the updated values in experiment (7) converged to the secondary path transfer characteristic C earlier compared to experiment (6).

Operation and Effect

In the active noise control device 10 of the present embodiment, the secondary path filter coefficient updating unit 40 performs weighted averaging of the filter coefficients C0ˆ and C1ˆ updated based on the updating formulae and the updated values stored in the updated value table 58. This enables the random error of the secondary path filter C to converge early, and thus it is possible to improve the noise reduction performance of the active noise control.

Third Embodiment

In the active noise control device 10 of this embodiment, the filter coefficients C0ˆ and C1ˆ are updated based on the following respective equations, in the first secondary path filter coefficient updater 40*a* and the second secondary path filter coefficient updater 40*b* of the secondary path filter coefficient updating unit 40.

$$C0\hat{}(f)_{n+1}=[\gamma\times Ct0\hat{}_n+(1-\gamma)\times C0\hat{}(f)_u]-\mu 2\times e1_n\times u0_n$$

$$C1\hat{}(f)_{n+1}=[\gamma\times Ct1\hat{}_n+(1-\gamma)\times C1\hat{}(f)_u]-\mu 3\times e1_n\times u1_n$$

where $Ct0\hat{}_n$ and $Ct1\hat{}_n$ are variables for holding the update results of the filter coefficients C0ˆ and C1ˆ of the previous time (time step n). $Ct0\hat{}_n$ and $Ct1\hat{}_1$, which are the initial values of the variables $Ct0\hat{}_n$ and $Ct1\hat{}_n$, are set at values as small as 0. γ is a coefficient that satisfies $0\leq\gamma\leq 1$.

Figure 13:
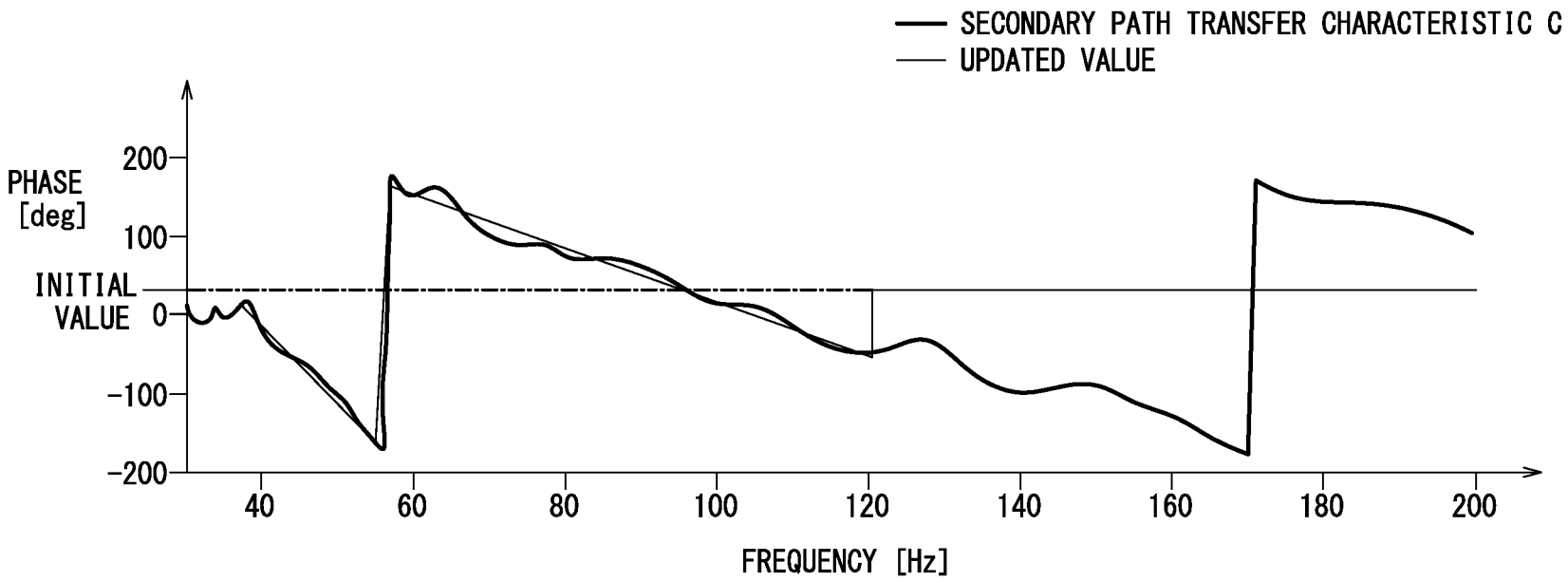
FIG. 13 is a graph showing phase characteristics of updated values.

FIG. 13 is a diagram showing the phase characteristic of the updated values stored in the updated value table 58 and the phase characteristic of a secondary path transfer characteristic C. The engine speed that is often used in normal driving is 3600 RPM or lower, and the frequency of the noise arising at that time is 120 Hz or lower. Therefore, in the frequency range of 120 Hz or lower, the filter coefficients C0ˆ and C1ˆ are updated repeatedly, so that the phase characteristic of the updated values substantially converges to the secondary path transfer characteristic C.

On the other hand, a range of the engine speed of higher than 3600 RPM is used for the driving in limited situations such as when the vehicle is accelerated to join from a ramp to a highway, or when climbing a steep uphill. Therefore, even when the active noise control has been continued for a certain period of time, the filter coefficients C0ˆ and C1ˆ are not updated in the range where the frequency is higher than 120 Hz, and the updated values remain equal to the initial values. Or, the filter coefficients C0ˆ and C1ˆ are not updated sufficiently, so that the secondary path filter Cˆ remains deviated from the secondary path transfer characteristic C. Therefore, when the engine speed exceeds 3600 RPM, the noise reduction performance by active noise control deteriorates, and the engine noise may suddenly increase.

Since the control target frequency f changes continuously with the passage of time, the control target frequency f of the previous time (time step n) is often a frequency near the control target frequency f of the current time (time step n+1). Further, since the secondary path transfer characteristic C changes continuously according to the control target frequency f, the secondary path transfer characteristic C in the previous time (time step n) and the secondary path transfer characteristic in the current time (time step n+1) C have similar characteristics.

Under consideration of the above fact, the filter coefficients C0ˆ and C1ˆ updated in the previous time (time step n) and the updated values corresponding to the control target frequency f of the current time (time step n+1) in the updated value table 58 are added at a predetermined ratio, and the resultant values are used as the previous values for the updating formulae to update the filter coefficients C0ˆ and C1ˆ.

Note that the coefficient γ may be provided for each frequency, and the coefficient γ may be attenuated according to the following equation as the number of updates of the filter coefficients C0ˆ and C1ˆ increases.

$$\gamma(f)_{n+1}=\gamma(f)_n\times \mathrm{Coef}_d$$

where $\mathrm{Coef}_d$ is an attenuation coefficient that is a positive number smaller than 1. In this case, the initial value of γ may be set to 1 or a value close to 1.

When the filter coefficients C0ˆ and C1ˆ for the control target frequency f are updated for the first time, γ takes a value close to 1. Therefore, since the filter coefficients C0ˆ and C1ˆ are updated mainly based on the previously updated filter coefficients C0ˆ and C1ˆ, it is possible to suppress deterioration of the noise reduction performance of the active noise control.

As the filter coefficients C0ˆ and C1ˆ at the control target frequency f are updated more frequently, γ is attenuated to 0. Therefore, since the filter coefficients C0ˆ and C1ˆ are updated mainly based on the updated values in the updated value table 58, the noise reduction performance of active noise control can be improved.

Further, a minimum value may be set for the coefficient γ.

$$\text{If } \gamma(f)_{n+1}<\gamma_{min}, \text{ Then } \gamma(f)_{n+1}=\gamma_{min}$$

Setting the minimum value for the coefficient γ allows the updating of the filter coefficients C0ˆ and C1ˆ to always involve the components of the previously updated filter coefficients C0ˆ and C1ˆ. Therefore, even if the secondary path transfer characteristic C abruptly changes during active noise control, the noise reduction performance can be restored by active noise control at an early stage.

Experimental Result

The present inventors conducted experiments on noise reduction performance of active noise control. The experimental results will be shown below. Each of the following experiments was performed under a secondary path transfer characteristic C having a gain characteristic shown by a thin line in FIG. 6A and a phase characteristic shown by a thin line in FIG. 6B.

Experiment (8)

In experiment (8), the sound pressure level of the noise in the vehicle passenger compartment 14 is measured during the first driving when the vehicle 12 is accelerated from the stopped state while active noise control is being performed by the active noise control device 10 of the present embodiment. In experiment (8), the initial values at each frequency in the initial value table 56 are set to convenient, small values. In experiment (8), γ is set to 0.5 (γ=0.5).

Experiment (9)

In experiment (9), the sound pressure level of the noise in the vehicle passenger compartment 14 is measured during the third driving when the vehicle 12 is accelerated from the stopped state while active noise control is being performed by the active noise control device 10 of the present embodiment. In experiment (9), the initial values at each frequency in the initial value table 56 are set to convenient, small values. In experiment (9), γ is set to 0.5 (γ=0.5).

Contrast of Experiments (1), (5), (8)

Figure 14:
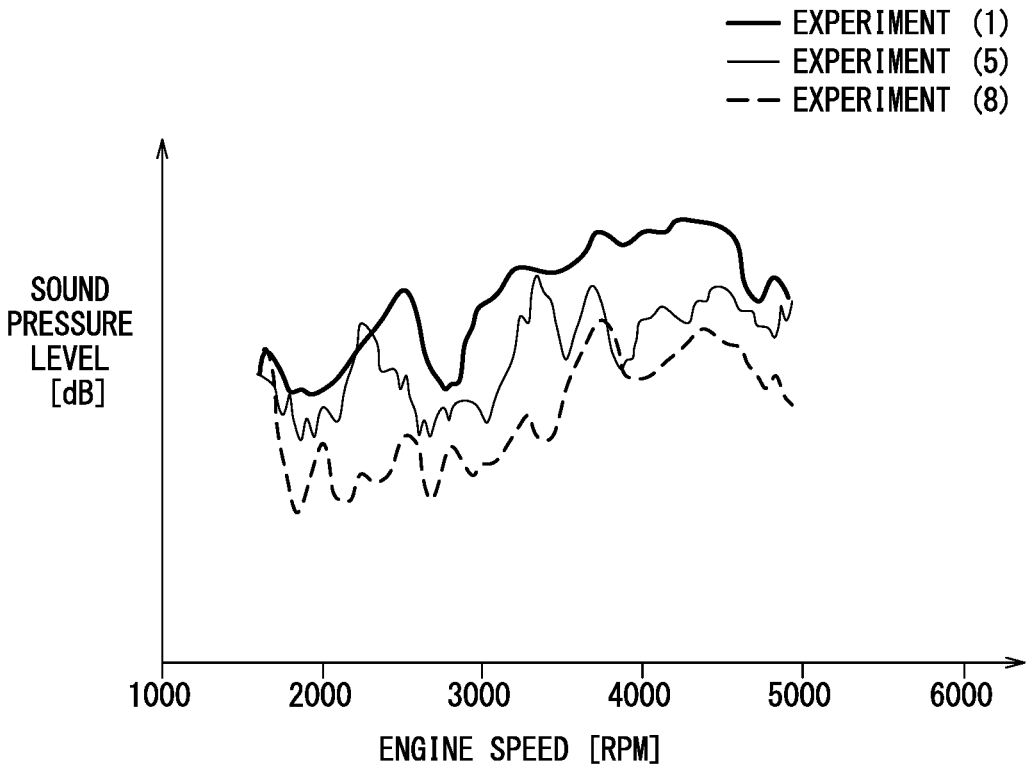
FIG. 14 is a graph showing the sound pressure levels of noise in the vehicle passenger compartment.

FIG. 14 is a graph showing the sound pressure levels of the noise in the vehicle passenger compartment 14, measured in the experiments (1), (5) and (8).

As shown in FIG. 14, at the time right after the start of driving the vehicle 12 at the engine speed of around 1600 RPM, the noise was hardly reduced in experiment (8), but after that, the noise reduction performance in experiment (8) was improved compared to experiment (5).

Comparison of Experiments (1), (6) and (9)

Figure 15:
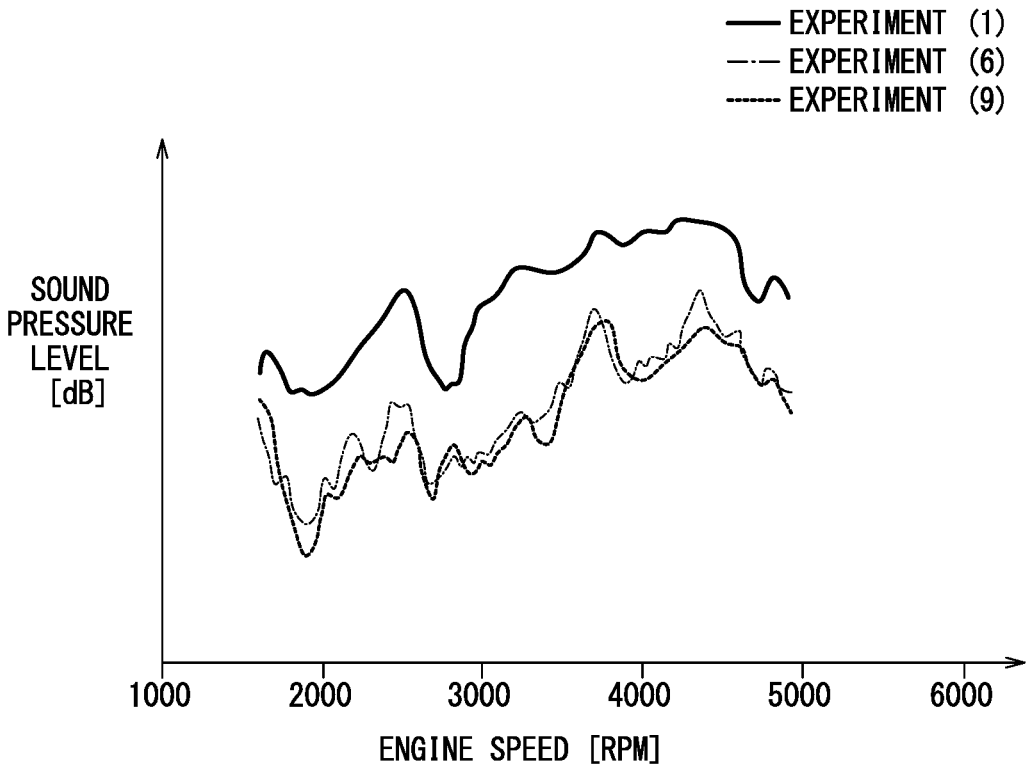
FIG. 15 is a graph showing the sound pressure levels of noise in the vehicle passenger compartment.

FIG. 15 is a graph showing the sound pressure levels of the noise in the vehicle passenger compartment 14, measured in the experiments (1), (6) and (9). When the number of drives reaches three times, in experiment (9) improvement in the reduction of the noise at around the engine speed of 1600 RPM right after the start of driving the vehicle 12 could be realized.

Operation and Effect

In the active noise control device 10 of the present embodiment, the secondary path filter coefficient updating unit 40 updates the current filter coefficients C^, by using, as the previous values, the values obtained by adding the previously updated filter coefficients of the secondary path filter C^ and the updated values read from the updated value table 58 at a predetermined ratio. With such a configuration, even when the accuracy of the updated values in the updated value table 58 is not high, the noise reduction performance of active noise control can be improved.

Fourth Embodiment

In this embodiment, the level of the anti-noise sound output from the speaker 16 is prevented from becoming excessive. Five methods 1 to 5 are shown below as signal processing methods for suppressing excessive loudness of the anti-noise sound output from the speaker 16.

Method 1

Figure 16:
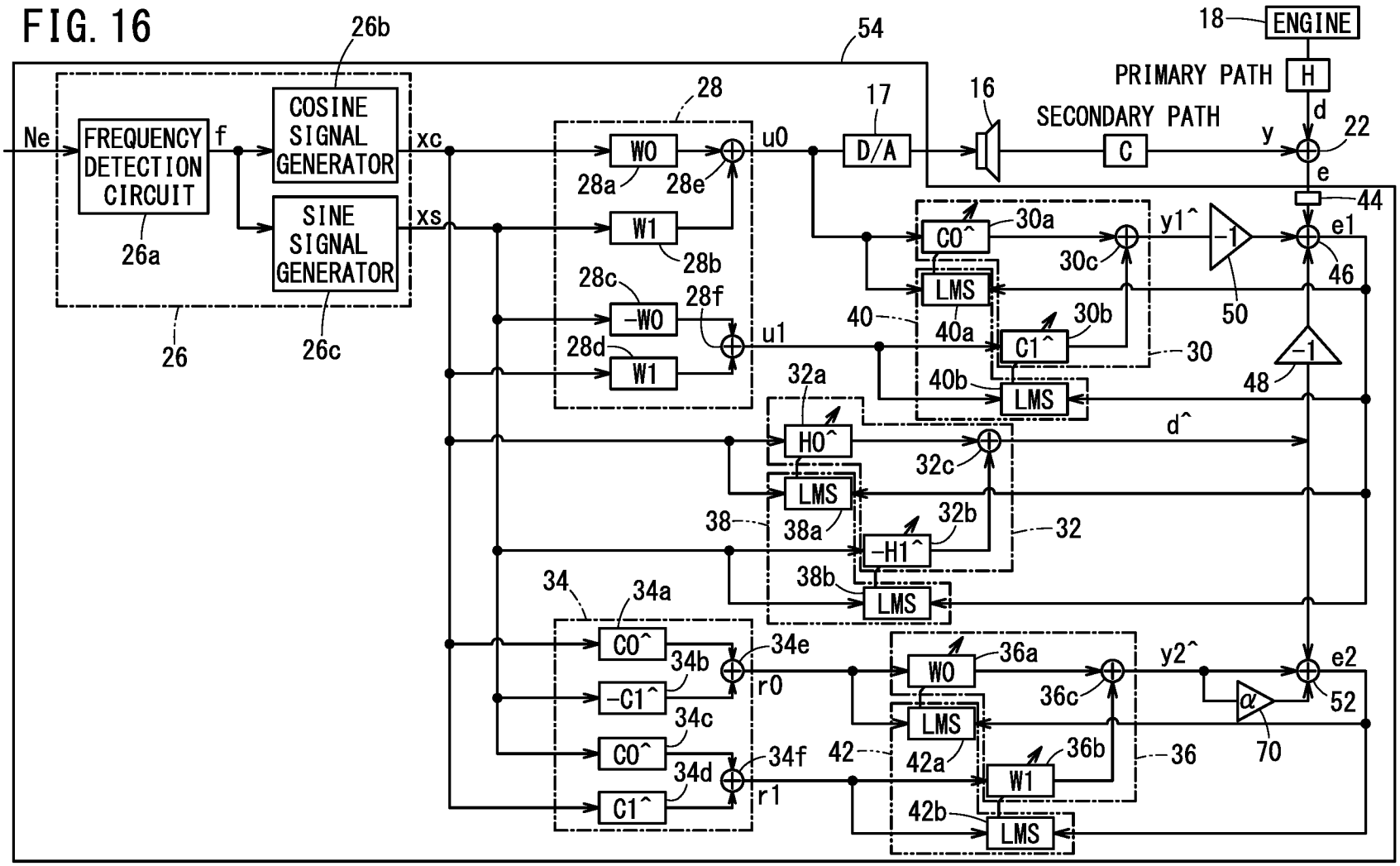
FIG. 16 is a block diagram of a signal processing unit.

FIG. 16 is a block diagram of a signal processing unit 54. As shown in FIG. 16, a multiplier 70 for multiplying the apparent magnitude of the second estimated anti-noise signal y2^ input to the adder 52 by (1+α) is added to that of the block diagram of FIG. 2. This increases the apparent magnitude of the second estimated anti-noise signal y2^ by (1+α) times, so that the size of the control filter W can be suppressed.

Method 2

Figure 17:
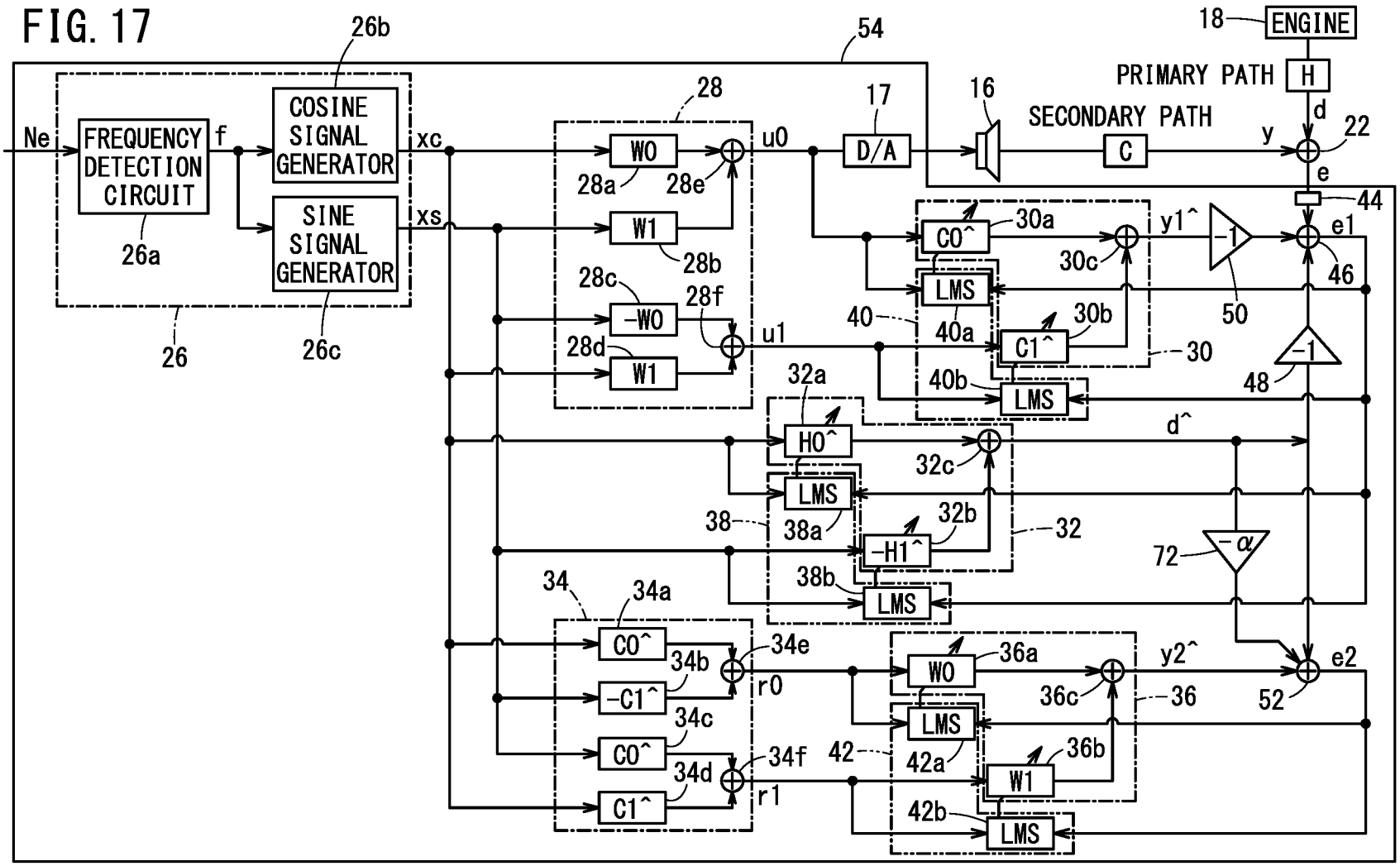
FIG. 17 is a block diagram of a signal processing unit.

FIG. 17 is a block diagram of a signal processing unit 54. As shown in FIG. 17, a multiplier 72 for multiplying the apparent magnitude of the estimated noise signal d^ input to the adder 52 by (1−α) is added to that of the block diagram of FIG. 2. This reduces the apparent magnitude of the estimated noise signal d^ by (1−α) times, so that the size of the control filter W can be suppressed.

Method 3

Figure 18:
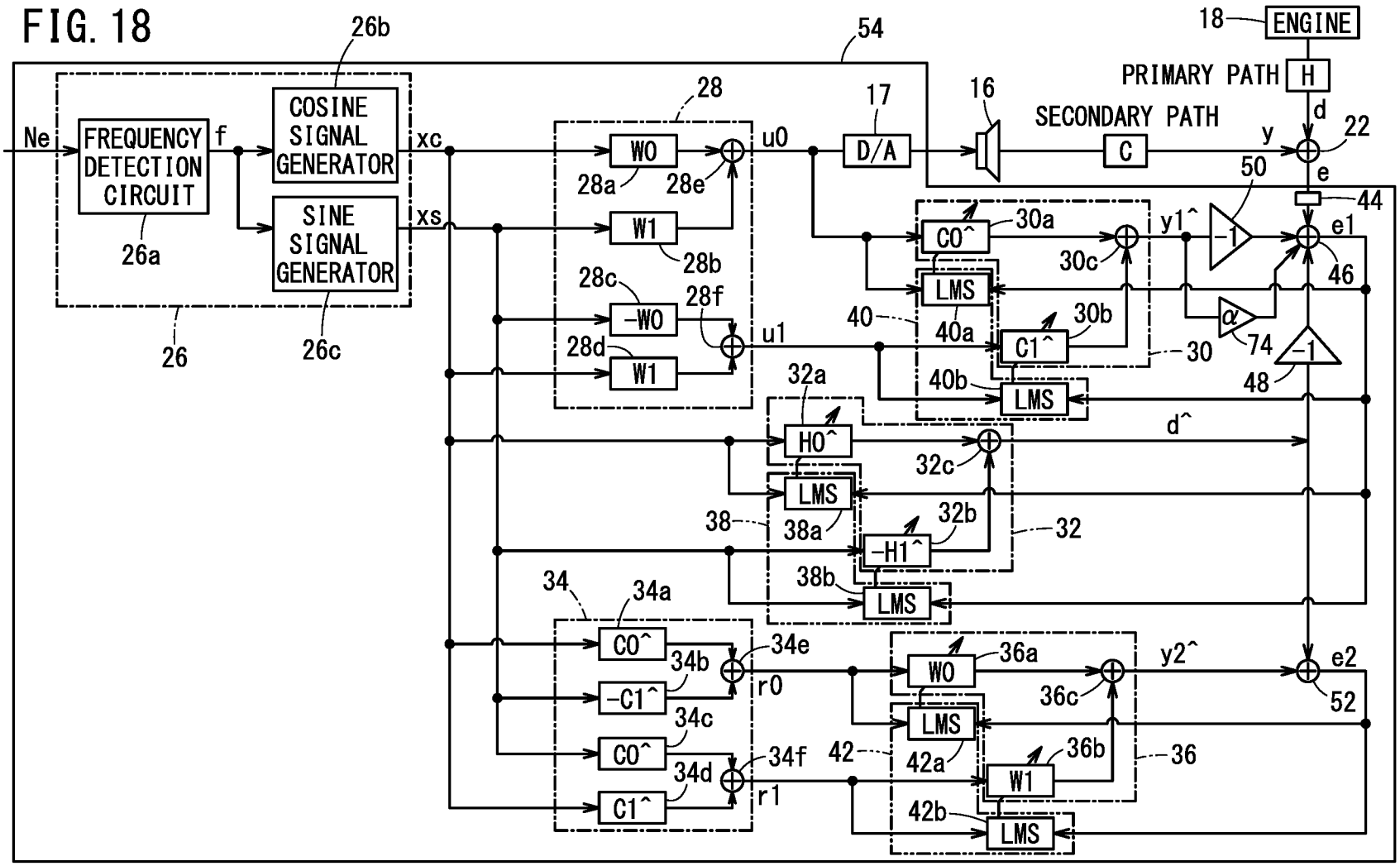
FIG. 18 is a block diagram of a signal processing unit.

FIG. 18 is a block diagram of a signal processing unit 54. As shown in FIG. 18, a multiplier 74 for multiplying the apparent magnitude of the first estimated anti-noise signal y1^ input to the adder 46 by (1−α) is added to that of the block diagram of FIG. 2.

Method 4

Figure 19:
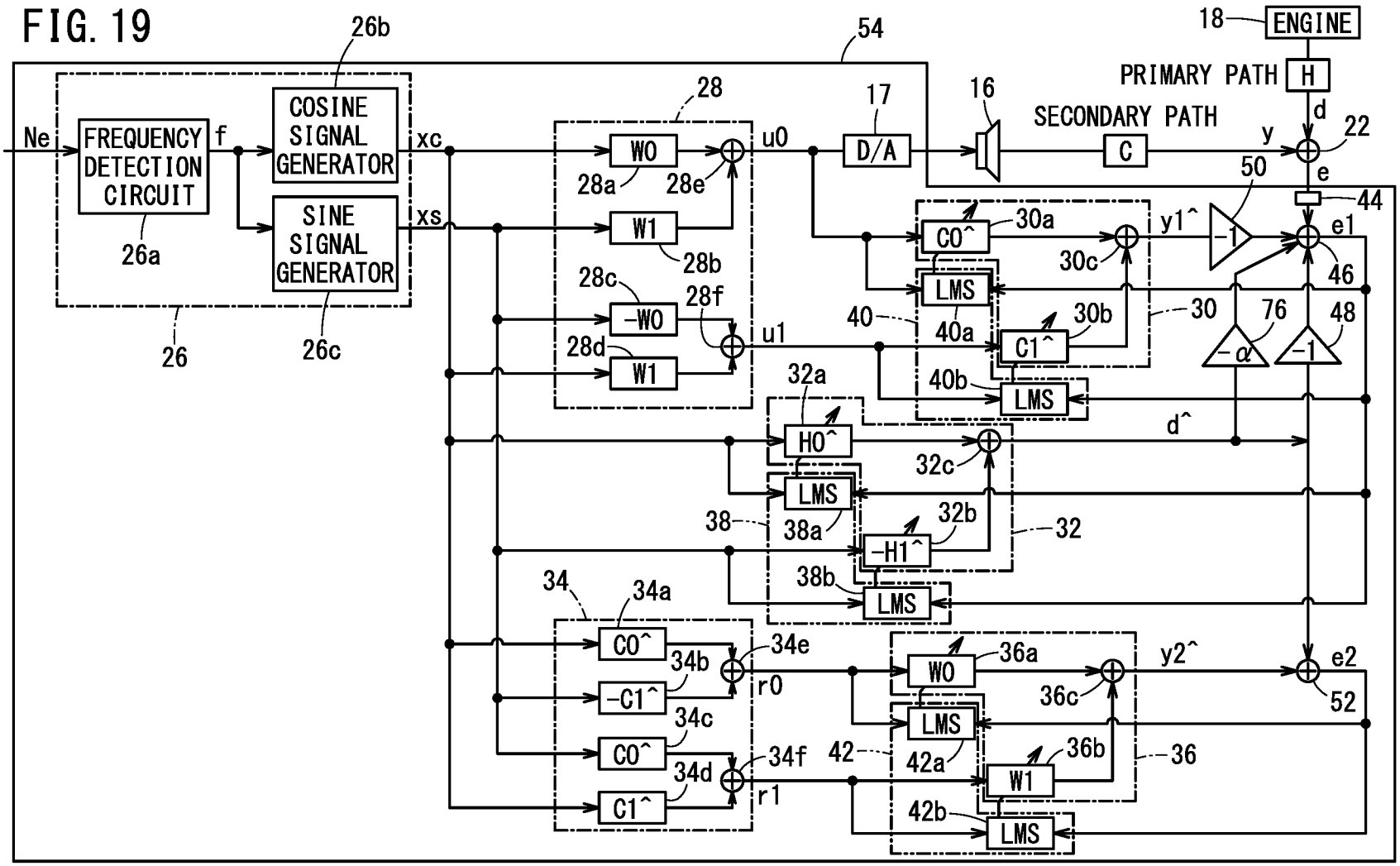
FIG. 19 is a block diagram of a signal processing unit.

FIG. 19 is a block diagram of a signal processing unit 54 to which a method 4 is applied. As shown in FIG. 19, a multiplier 76 for multiplying the apparent magnitude of the estimated noise signal d^ input to the adder 46 by (1+α) is added to that of the block diagram of FIG. 2.

Method 5

Figure 20:
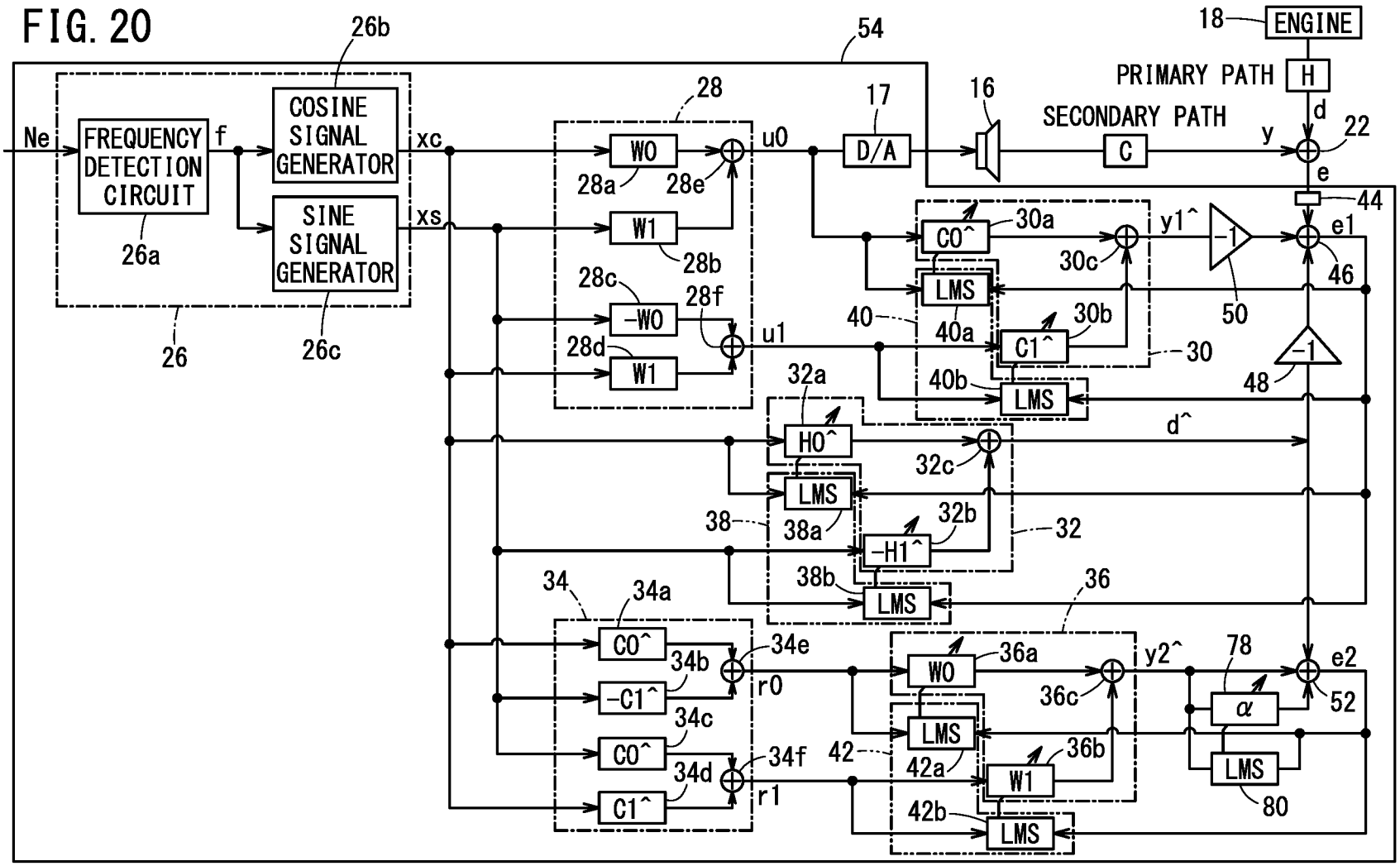
FIG. 20 is a block diagram of a signal processing unit.

FIG. 20 is a block diagram of a signal processing unit 54. As shown in FIG. 20, a filter 78 for multiplying the apparent magnitude of the second estimated anti-noise signal y2^ input to the adder 52 by (1+α) is added to that of the block diagram of FIG. 2. The filter coefficient, designated at α, of the filter 78 is updated by a filter coefficient updating unit 80.

In method 5, the minimum value $\alpha_{min}$ is set for the filter coefficient α. The filter coefficient α satisfies the following equation.

$$\text{If } \alpha_n < \alpha_{min}, \text{ Then } \alpha_n = \alpha_{min}$$

When the secondary path transfer characteristic C changes significantly, such as when the backrest of the seat 20 is tilted back, the difference between the updated values in the updated value table 58 and the secondary path transfer characteristic C becomes large. In the active noise control of the present embodiment, the coefficients C0^ and C1^ of the secondary path filter C^ change following the change of the secondary path transfer characteristic C. Therefore, the sound pressure level of the anti-noise sound output from the speaker 16 may suddenly change, thereby causing the occupant to feel discomfort. By updating the filter coefficient α in a range greater than the minimum value $\alpha_{min}$ by the filter coefficient updating unit 80, it is possible to prevent excessive loudness of the anti-noise sound output from the speaker 16 during the transitional state in which the change of the secondary path transfer characteristic C is followed. Thus, it is possible to alleviate the feeling of discomfort for the occupant.

Experimental Result

The present inventors conducted experiments on noise reduction performance of active noise control. The experimental results will be shown below. Each of the following experiments was performed under a secondary path transfer characteristic C having a gain characteristic shown by a thin line in FIG. 6A and a phase characteristic shown by a thin line in FIG. 6B.

Experiment (10)

In experiment (10), the amplitude of the control filter W is measured when the vehicle 12 is accelerated from the stopped state while active noise control is being performed by the active noise control device 10 of the present embodiment. Further, in experiment (10), the sound pressure level of the noise in the vehicle passenger compartment 14 is measured when the vehicle 12 is on. In experiment (10), α was set equal to 0 (α=0) in the above method 1. In experiment (10), the initial values at each frequency in the initial value table 56 is set to the measurement values of the secondary path transfer characteristic C at each frequency shown by the thin lines in FIGS. 6A and 6B.

Experiment (11)

In experiment (11), the amplitude of the control filter W is measured when the vehicle 12 is accelerated from the stopped state while active noise control is being performed by the active noise control device 10 of the present embodiment. Further, in experiment (11), the sound pressure level of the noise in the vehicle passenger compartment 14 is measured when the vehicle 12 is on. In experiment (11), α was set equal to 0.25 (α=0.25) in the above method 1. In experiment (11), the initial values at each frequency in the initial value table 56 is set to the measurement values of the secondary path transfer characteristic C at each frequency shown by the thin lines in FIGS. 6A and 6B.

Comparison of Results of Experiments (10) and (11)

Figure 21:
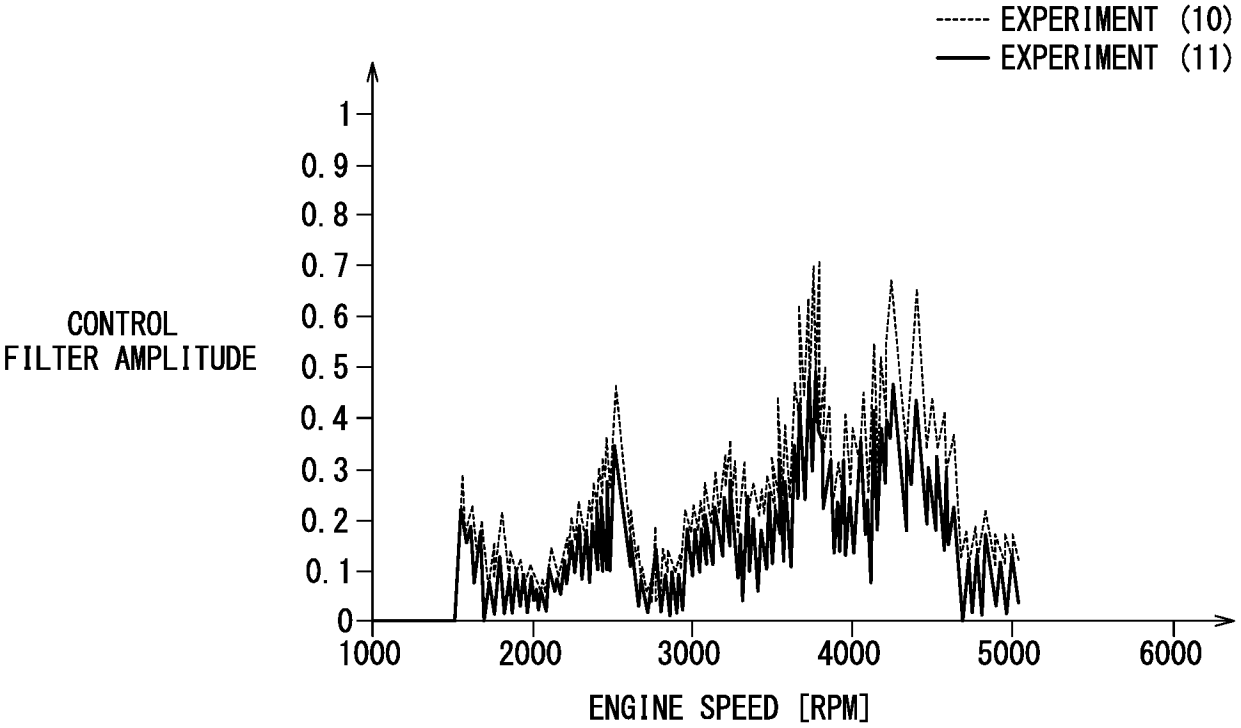
FIG. 21 is a graph showing the amplitudes of control filters.

FIG. 21 is a graph showing the amplitudes of the control filter W, measured in the experiments (10) and (11). As shown in FIG. 21, the level of the amplitude of the control filter W is reduced in experiment (11) in which α=0.25 as compared to experiment (10) in which α=0.

Comparison of Experiments (1), (10) and (11)

Figure 22:
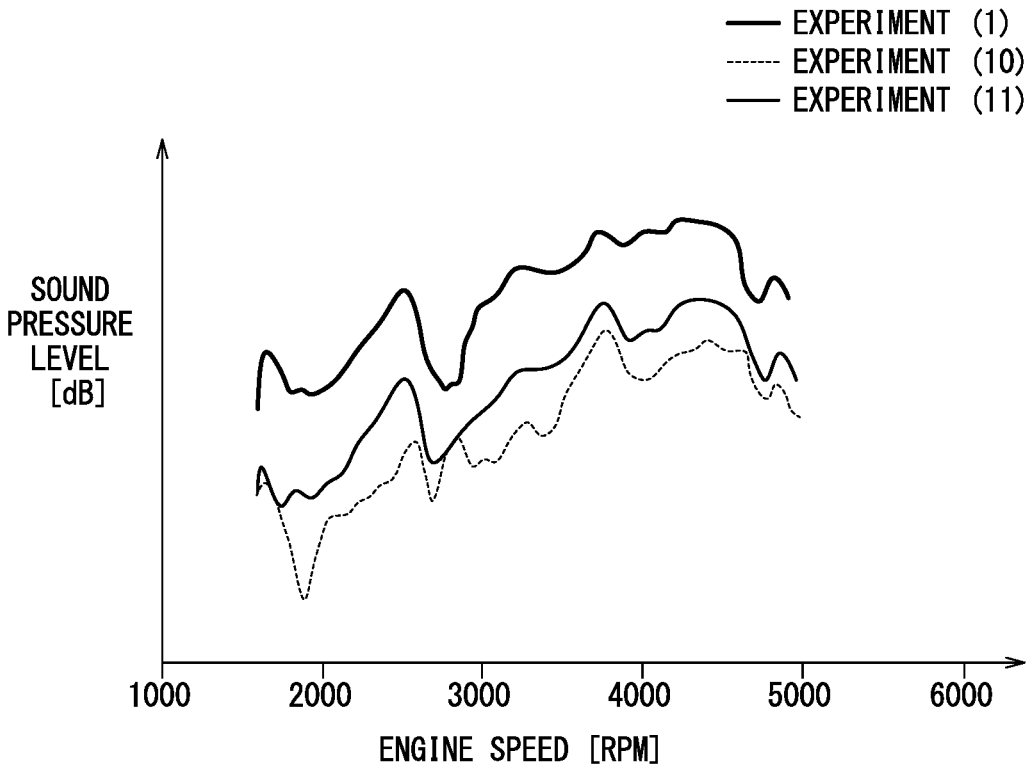
FIG. 22 is a graph showing the sound pressure levels of noise in the vehicle passenger compartment.

FIG. 22 is a graph showing the sound pressure levels of the noise in the vehicle passenger compartment 14, measured in the experiments (1), (10) and (11). As shown in FIG. 22, it can be seen that the noise reduction performance is improved in experiment (11) in which α=0.25, as compared to experiment (10) in which α=0.

Operation and Effect

In the active noise control device 10 of the present embodiment, the signal processing unit 54 includes the multiplier 70 that adjusts and increases the magnitude of the second estimated anti-noise signal y2ˆ used to generate the second virtual error signal e2, the multiplier 72 that adjusts and reduces the magnitude of the estimated noise signal dˆ used to generate the second virtual error signal e2, the multiplier 74 that adjusts and reduces the magnitude of the first estimated anti-noise signal y1ˆ used to generate the first virtual error signal e1, or the multiplier 76 that adjusts and increases the magnitude of the estimated noise signal dˆ used to generate the first virtual error signal e1. With this configuration, it is possible to prevent excessive loudness of the anti-noise sound output from the speaker 16.

Technical Idea Obtained from Embodiments

The technical ideas that can be grasped from the above embodiments are described below.

An active noise control device (10) performs active noise control for controlling a speaker (16) based on an error signal that changes in accordance with the combined sound of a noise transmitted from a vibration source and an anti-noise sound for cancelling the noise, output from the speaker, the active noise control device including: a standard signal generation unit (26) configured to generate a standard signal in accordance with a control target frequency; a control signal generation unit (28) configured to generate a control signal for controlling the speaker by signal-processing the standard signal through a control filter that is an adaptive notch filter; an estimated noise signal generation unit (32) configured to generate an estimated noise signal by signal-processing the standard signal through a primary path filter that is an adaptive notch filter; a first estimated anti-noise signal generation unit (30) configured to generate a first estimated anti-noise signal by signal-processing the control signal through a secondary path filter that is an adaptive notch filter; a reference signal generation unit (34) configured to generate a reference signal by signal-processing the standard signal through the secondary path filter; a second estimated anti-noise signal generation unit (36) configured to generate a second estimated anti-noise signal by signal-processing the reference signal through the control filter; a first virtual error signal generation unit (46) configured to generate a first virtual error signal from the error signal, the first estimated anti-noise signal, and the estimated noise signal; a second virtual error signal generation unit (52) configured to generate a second virtual error signal from the second estimated anti-noise signal and the estimated noise signal; a secondary path filter coefficient updating unit (40) configured to successively and adaptively update the coefficients of the secondary path filter so as to minimize the magnitude of the first virtual error signal, based on the control signal and the first virtual error signal; a control filter coefficient updating unit (42) configured to successively and adaptively update the coefficients of the control filter so as to minimize the magnitude of the second virtual error signal, based on the reference signal and the second virtual error signal; an initial value table (56) configured to store initial values of the coefficients of the secondary path filter in association with a frequency, in a table format; an updated value table (58) configured to store updated values of the coefficients of the secondary path filter in association with the frequency, in a table format; an updated value table operating unit (64) configured to write the initial values of the initial value table into the updated value table as the updated values at the start of the active noise control and write the coefficients of the secondary path filter updated by the secondary path filter coefficient updating unit during the active noise control, into the updated value table as the updated values. The secondary path filter coefficient updating unit is configured to read the updated values corresponding to the frequency from the updated value table before updating the coefficients of the secondary path filter, and update the coefficients of the secondary path filter, using the read updated values as the previous values.

The above active noise control device may include a primary path filter coefficient updating unit (38) configured to successively and adaptively update the coefficients of the primary path filter so as to minimize the magnitude of the first virtual error signal, based on the standard signal and the first virtual error signal.

The above active noise control device may include an initial value table operating unit (62) configured to rewrite the initial values in the initial value table with the updated values of the updated value table at the end of the active noise control.

The above active noise control device may include a determination unit (68) configured to determine whether an abnormality or divergence has occurred in the active noise control, at the end of the active noise control, and the initial value table operating unit may be configured not to rewrite the initial values in the initial value table with the updated values of the updated value table when the determination unit determines that an abnormality or divergence has occurred in the active noise control.

In the above active noise control device, the secondary path filter coefficient updating unit may be configured to perform weighted averaging of the coefficients of the secondary path filter updated according to updating formulae and the updated values in the updated value table.

In the above active noise control device, the secondary path filter coefficient updating unit may be configured to update the coefficients of the secondary path filter, by using, as the previous values, the values obtained by adding the coefficients of the secondary path filter after the previous updating in the secondary path filter coefficient updating unit and the read updated values at a predetermined ratio.

The above active noise control device may include a determination unit configured to determine whether an abnormality or divergence has occurred in the active noise control, at the end of the active noise control, a result value table (60) configured to store the result values of the coefficients of the secondary path filter in association with the frequency, in a table format, and a result value table operating unit (66) configured to rewrite the result values in the result value table with the updated values of the updated value tale when the determination unit determines an abnormality or divergence has occurred in the active noise control.

The above active noise control device may include a multiplier (70, 72, 74, 76) which makes an adjustment so as to increase the magnitude of the second estimated anti-noise signal used for generation of the second virtual error signal, which makes an adjustment so as to reduce the magnitude of the estimated noise signal used for generation of the second virtual error signal, which makes an adjustment so as to reduce the magnitude of the first estimated anti-noise signal used for generation of the first virtual error signal, or which makes an adjustment so as to increase the magnitude of the estimated noise signal used for generation of the first virtual error signal.

The present invention is not particularly limited to the embodiment described above, and various modifications are possible without departing from the essence and gist of the present invention.

What is claimed is:

1. An active noise control device that performs active noise control for controlling a speaker based on an error signal that changes in accordance with combined sound of a noise transmitted from a vibration source and an anti-noise sound for cancelling the noise, output from the speaker, the active noise control device comprising one or more processors that execute computer-executable instructions stored in a memory, wherein the one or more processors execute the computer-executable instructions to cause the active noise control device to:

generate a standard signal in accordance with a control target frequency;

generate a control signal for controlling the speaker by signal-processing the standard signal through a control filter that is an adaptive notch filter;

generate an estimated noise signal by signal-processing the standard signal through a primary path filter that is an adaptive notch filter;

generate a first estimated anti-noise signal by signal-processing the control signal through a secondary path filter that is an adaptive notch filter;

generate a reference signal by signal-processing the standard signal through the secondary path filter;

generate a second estimated anti-noise signal by signal-processing the reference signal through the control filter;

generate a first virtual error signal from the error signal, the first estimated anti-noise signal, and the estimated noise signal;

generate a second virtual error signal from the second estimated anti-noise signal and the estimated noise signal;

successively and adaptively update a coefficient of the secondary path filter so as to minimize magnitude of the first virtual error signal, based on the control signal and the first virtual error signal;

successively and adaptively update a coefficient of the control filter so as to minimize magnitude of the second virtual error signal, based on the reference signal and the second virtual error signal;

store initial values of the coefficient of the secondary path filter into an initial value table in association with a frequency, in a table format;

store updated values of the coefficient of the secondary path filter into an updated value table in association with the frequency, in a table format;

write the initial values of the initial value table into the updated value table as the updated values at start of the active noise control and write the coefficient of the secondary path filter updated during the active noise control, into the updated value table as the updated values; and read the updated value corresponding to the frequency from the updated value table before updating the coefficient of the secondary path filter, and update the coefficient of the secondary path filter, using the read updated value as a previous value.

2. The active noise control device according to claim 1, wherein the one or more processors cause the active noise control device to successively and adaptively update a coefficient of the primary path filter so as to minimize the magnitude of the first virtual error signal, based on the standard signal and the first virtual error signal.

3. The active noise control device according to claim 1, wherein the one or more processors cause the active noise control device to rewrite the initial values in the initial value table with the updated values of the updated value table at end of the active noise control.

4. The active noise control device according to claim 3, wherein the one or more processors cause the active noise control device to:

determine whether an abnormality or divergence has occurred in the active noise control, at the end of the active noise control, and not rewrite the initial values in the initial value table with the updated values of the updated value table when it is determined, in the determining, that an abnormality or divergence has occurred in the active noise control.

5. The active noise control device according to claim 1, wherein the one or more processors cause the active noise control device to perform weighted averaging of the coefficient of the secondary path filter updated according to an updating formula and the updated values in the updated value table.

6. The active noise control device according to claim 1, wherein the one or more processors cause the active noise control device to update the coefficient of the secondary path filter, by using, as the previous value, a value obtained by adding the coefficient of the secondary path filter after the previous updating of the coefficient of the secondary path filter and the read updated value at a predetermined ratio.

7. The active noise control device according to claim 1, wherein the one or more processors cause the active noise control device to:

determine whether an abnormality or divergence has occurred in the active noise control, at end of the active noise control;

store result values of the coefficient of the secondary path filter into a result value table in association with the frequency, in a table format; and rewrite the result values in the result value table with the updated values of the updated value tale when it is determined that an abnormality or divergence has occurred in the active noise control.

8. The active noise control device according to claim 1, wherein the one or more processors cause the active noise control device to:

make an adjustment so as to increase magnitude of the second estimated anti-noise signal used for generation of the second virtual error signal;

make an adjustment so as to reduce magnitude of the estimated noise signal used for generation of the second virtual error signal;

make an adjustment so as to reduce magnitude of the first estimated anti-noise signal used for generation of the first virtual error signal; or make an adjustment so as to increase the magnitude of the estimated noise signal used for generation of the first virtual error signal.

* * * * *